US011033918B2

(12) United States Patent
Jones et al.

(10) Patent No.: US 11,033,918 B2
(45) Date of Patent: Jun. 15, 2021

(54) INVERTIBLE HAND HELD TRIGGER SPRAYER

(71) Applicant: OP-Hygiene IP GmbH, Niederbipp (CH)

(72) Inventors: Andrew Jones, St. Anns (CA); Heiner Ophardt, Arisdorf (CH)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/801,709

(22) Filed: Feb. 26, 2020

(65) Prior Publication Data

US 2020/0276603 A1 Sep. 3, 2020

Related U.S. Application Data

(60) Provisional application No. 62/811,920, filed on Feb. 28, 2019.

(51) Int. Cl.
*B05B 11/00* (2006.01)

(52) U.S. Cl.
CPC ..... *B05B 11/0059* (2013.01); *B05B 11/3009* (2013.01); *B05B 11/3071* (2013.01)

(58) Field of Classification Search
CPC ..... B05B 11/3011; B05B 11/3052; B05B 11/0059; B05B 11/3009; B05B 11/3071; B05B 11/0094; B05B 11/047
USPC ..... 222/321.4, 331
See application file for complete search history.

(56) References Cited

U.S. PATENT DOCUMENTS

| | | | | |
|---|---|---|---|---|
| 1,185,639 A * | 6/1916 | Dunlap | B05B 11/0059 | 222/376 |
| 4,277,001 A * | 7/1981 | Nozawa | B05B 11/0059 | 222/321.4 |
| 5,119,974 A * | 6/1992 | Mann | B05B 11/3011 | 222/376 |
| 5,341,967 A * | 8/1994 | Silvenis | B05B 11/0059 | 222/376 |
| 5,540,360 A * | 7/1996 | Foster | B05B 11/0059 | 222/376 |
| 5,542,581 A * | 8/1996 | Habora | B05B 11/0037 | 222/331 |
| 5,657,909 A * | 8/1997 | Barriac | B05B 11/0059 | 222/382 |
| 6,386,399 B1 * | 5/2002 | Tsujii | B05B 11/3057 | 222/376 |
| 7,682,097 B2 | 3/2010 | Knopow et al. | | |

(Continued)

FOREIGN PATENT DOCUMENTS

| | | |
|---|---|---|
| GB | 2478141 | 8/2011 |
| NL | 7705747 | 12/1977 |

*Primary Examiner* — Vishal Pancholi
(74) *Attorney, Agent, or Firm* — Thorpe North and Western LLP

(57) ABSTRACT

A fluid dispenser having a first fluid outlet for dispensing fluid when in a first orientation and a second fluid outlet for dispensing fluid when in a second orientation. An outlet valve mechanism directs the fluid towards the first fluid outlet in the first orientation, and towards the second fluid outlet when in the second orientation. The outlet valve mechanism includes a movable outlet member that is located at a first position when the fluid dispenser is in the first orientation, and is located at a second position when the fluid dispenser is in the second orientation.

20 Claims, 9 Drawing Sheets

(56) References Cited

U.S. PATENT DOCUMENTS

| | | | | |
|---|---|---|---|---|
| 2008/0264977 | A1* | 10/2008 | Moudgill | B05B 11/0059 222/376 |
| 2009/0184177 | A1 | 7/2009 | Wu et al. | |
| 2018/0141065 | A1 | 5/2018 | Son | |

* cited by examiner

INVERTIBLE HAND HELD TRIGGER SPRAYER

FIELD OF THE INVENTION

This invention relates to hand held spray bottles, and more particularly to spray bottles that have one outlet for spraying a fluid onto a surface, and another outlet for discharging the fluid into an application member such as a cloth or a brush.

BACKGROUND OF THE INVENTION

Devices such as hand held spray bottles for spraying cleaning fluids onto a surface are known in the art. It is also known to incorporate into the spray device a tool for applying the cleaning fluid to the surface, such as a cloth or a brush. For example, U.S. Pat. No. 7,682,097 to Knopow et al., issued Mar. 23, 2010, teaches a cleaning device that can selectively dispense a cleaning solution through either a spray nozzle or an applicator pad. The cleaning device includes a manually rotatable valve which is used to select whether the solution is dispensed through the spray nozzle or the pad.

A disadvantage of the prior art arises in that selecting where the solution dispenses from requires manual rotation of the valve, which can be inconvenient and time consuming. The solution can also be inadvertently dispensed from the wrong outlet, for example if the user forgets to rotate the valve or accidentally rotates the valve to the wrong position.

SUMMARY OF THE INVENTION

To at least partially overcome some of the disadvantages of previously known devices, the present invention provides a fluid dispenser having a first fluid outlet, a second fluid outlet, and an outlet valve mechanism for directing a fluid to the first fluid outlet when the dispenser is in a first orientation, and to the second fluid outlet when the dispenser is in a second orientation. The inventors have appreciated that the outlet valve mechanism allows the fluid to be conveniently dispensed from either the first fluid outlet or the second fluid outlet depending on the orientation of the device, without requiring a user to manually rotate a rotatable valve or the like. For example, the first fluid outlet may dispense the fluid as a stream or a spray when the dispenser is in an upright orientation, and the second fluid outlet may dispense the fluid into an application tool, such as a cloth or a pad, when the dispenser is in an inverted orientation. The application tool is preferably positioned on or near the top of the dispenser, so that the dispenser is inverted to apply the application tool to an upwardly facing surface, such as a counter top or floor. The dispenser thus automatically directs the fluid to the correct fluid outlet depending on whether the dispenser is being held upwardly for spraying or inverted for use of the application tool.

The outlet valve mechanism uses the force of gravity to direct the fluid to the correct fluid outlet depending on the orientation of the dispenser. In particular, the outlet valve mechanism includes a movable outlet member, such as a ball, that is located at a first position when the dispenser is in the first orientation, and at a second position when the dispenser is in the second orientation. The first position is lower than the second position when the dispenser is in the first orientation, and the second position is lower than the first position when the dispenser is in the second orientation, such that the movable outlet member moves to either the first position or the second position under the force of gravity, depending on whether the dispenser is in the first orientation or the second orientation. When the movable outlet member is at the first position, the outlet valve mechanism allows the fluid to pass through outlet valve mechanism towards the first fluid outlet, and prevents the fluid from passing through the outlet valve mechanism towards the second fluid outlet. When the movable outlet member is at the second position, the outlet valve mechanism allows the fluid to pass through the outlet valve mechanism towards the second fluid outlet, and prevents the fluid from passing through the outlet valve mechanism towards the first fluid outlet.

The fluid dispenser can also include a first inlet valve mechanism for delivering the fluid from a fluid reservoir to a pump mechanism when the fluid dispenser is in the first orientation, and a second inlet valve mechanism for delivering the fluid from the fluid reservoir to the pump mechanism when the fluid dispenser is in the second orientation. Having separate inlet valve mechanisms for delivering the fluid to the pump mechanism when in the first orientation or the second orientation allows the fluid to be drawn from different parts of the fluid reservoir depending on the orientation of the dispenser. For example, the first inlet valve mechanism can be arranged to draw the fluid from a bottom portion of the fluid reservoir, where the fluid pools when the dispenser is upright, and the second inlet valve mechanism can be arranged to draw the fluid from a top portion of the fluid reservoir, where the fluid pools when the dispenser is inverted. This allows the dispenser to continue dispensing in both orientations as the level of fluid within the reservoir gets depleted.

Accordingly, in one aspect the present invention resides in a fluid dispenser comprising:

a fluid reservoir containing a fluid to be dispensed;

a first fluid outlet for dispensing the fluid when the fluid dispenser is in a first orientation;

a second fluid outlet for dispensing the fluid when the fluid dispenser is in a second orientation;

an outlet valve mechanism for directing the fluid towards the first fluid outlet when the fluid dispenser is in the first orientation, and towards the second fluid outlet when the fluid dispenser is in the second orientation; and a pump mechanism that, when activated, forces an allotment of the fluid through the outlet valve mechanism to be discharged from either the first fluid outlet or the second fluid outlet;

wherein the outlet valve mechanism comprises a movable outlet member that is located at a first position when the fluid dispenser is in the first orientation, and is located at a second position when the fluid dispenser is in the second orientation;

wherein the movable outlet member moves from the first position to the second position under the force of gravity when the fluid dispenser moves from the first orientation to the second orientation;

wherein the movable outlet member moves from the second position to the first position under the force of gravity when the fluid dispenser moves from the second orientation to the first orientation;

wherein, when the movable outlet member is at the first position, the outlet valve mechanism allows the fluid to pass through the outlet valve mechanism towards the first fluid outlet, and prevents the fluid from passing through the outlet valve mechanism towards the second fluid outlet; and wherein, when the movable outlet member is at the second position, the outlet valve mechanism allows the fluid to pass through the outlet valve mechanism towards the second fluid outlet, and prevents the fluid from passing through the outlet valve mechanism towards the first fluid outlet.

In preferred embodiments, the movable outlet member is movably disposed within an outlet valve chamber, the outlet valve chamber having an inlet opening, a first outlet opening, and a second outlet opening;

wherein the inlet opening is in fluid communication with the pump mechanism for receiving the fluid upon activation of the pump mechanism;

wherein the first outlet opening is in fluid communication with the first fluid outlet;

wherein the second outlet opening is in fluid communication with the second fluid outlet;

wherein, when the movable outlet member is at the first position:

(i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; and wherein, when the movable outlet member is at the second position:

(i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening.

Optionally, the movable outlet member comprises an outlet ball;

wherein, when the fluid dispenser is in the first orientation and the outlet ball is at the first position:

(i) the outlet ball is located downwardly from the first outlet opening, and (ii) the outlet ball is located upwardly from the second outlet opening; and wherein, when the fluid dispenser is in the second orientation and the outlet ball is at the second position:

(i) the outlet ball is located upwardly from the first outlet opening, and (ii) the outlet ball is located downwardly from the second outlet opening.

In some preferred embodiments, the fluid dispenser further comprises:

a first inlet valve mechanism for delivering the fluid from the fluid reservoir to the pump mechanism when the fluid dispenser is in the first orientation; and a second inlet valve mechanism for delivering the fluid from the fluid reservoir to the pump mechanism when the fluid dispenser is in the second orientation;

wherein the first inlet valve mechanism comprises a first movable inlet member that is located at a first position when the fluid dispenser is in the first orientation, and is located at a second position when the fluid dispenser is in the second orientation;

wherein the first movable inlet member moves from the first position to the second position under the force of gravity when the fluid dispenser moves from the first orientation to the second orientation;

wherein the first movable inlet member moves from the second position to the first position under the force of gravity when the fluid dispenser moves from the second orientation to the first orientation;

wherein, when the first movable inlet member is at the first position, the first inlet valve mechanism allows fluid to pass from the fluid reservoir, through the first inlet valve mechanism, to the pump mechanism;

wherein, when the first movable inlet member is at the second position, the first inlet valve mechanism prevents fluid from passing from the fluid reservoir, through the first inlet valve mechanism, to the pump mechanism;

wherein the second inlet valve mechanism comprises a second movable inlet member that is located at a first position when the fluid dispenser is in the first orientation, and is located at a second position when the fluid dispenser is in the second orientation;

wherein the second movable inlet member moves from the first position to the second position under the force of gravity when the fluid dispenser moves from the first orientation to the second orientation;

wherein the second movable inlet member moves from the second position to the first position under the force of gravity when the fluid dispenser moves from the second orientation to the first orientation;

wherein, when the second movable inlet member is at the first position, the second inlet valve mechanism prevents fluid from passing from the fluid reservoir, through the second inlet valve mechanism, to the pump mechanism; and wherein, when the second movable inlet member is at the second position, the second inlet valve mechanism allows fluid to pass from the fluid reservoir, through the second inlet valve mechanism, to the pump mechanism.

Preferably, the first movable inlet member is movably disposed within a first inlet valve chamber, the first inlet valve chamber having a first inlet port and a first outlet port;

wherein the first inlet port is in fluid communication with the fluid reservoir;

wherein the first outlet port is in fluid communication with the pump mechanism;

wherein, when the first movable inlet member is at the first position, the first movable inlet member is spaced from the first outlet port and engages with the first inlet port, and allows fluid to pass from the fluid reservoir, through the first inlet valve chamber, to the pump mechanism;

wherein, when the first movable inlet member is at the second position, the first movable inlet member is spaced from the first inlet port and engages with the first outlet port to prevent fluid from passing from the fluid reservoir, through the first inlet valve chamber, to the pump mechanism;

wherein the second movable inlet member is movably disposed within a second inlet valve chamber, the second inlet valve chamber having a second inlet port and a second outlet port;

wherein the second inlet port is in fluid communication with the fluid reservoir;

wherein the second outlet port is in fluid communication with the pump mechanism;

wherein, when the second movable inlet member is at the first position, the second movable inlet member is spaced from the second inlet port and engages with the second outlet port to prevent fluid from passing from the fluid reservoir, through the second inlet valve chamber, to the pump mechanism; and wherein, when the second movable inlet member is at the second position, the second movable inlet member is spaced from the second outlet port and engages with the second inlet port, and allows fluid to pass from the fluid reservoir, through the second inlet valve chamber, to the pump mechanism.

Optionally, the first movable inlet member comprises a first inlet ball;

wherein, when the fluid dispenser is in the first orientation and the first inlet ball is at the first position:

(i) the first inlet ball is located downwardly from the first outlet port, and (ii) the first inlet ball is located upwardly from the first inlet port;

wherein, when the fluid dispenser is in the second orientation and the first inlet ball is at the second position:

(i) the first inlet ball is located upwardly from the first outlet port, and (ii) the first inlet ball is located downwardly from the first inlet port;

wherein the second movable inlet member comprises a second inlet ball;

wherein, when the fluid dispenser is in the first orientation and the second inlet ball is at the first position:

(i) the second inlet ball is located upwardly from the second outlet port, and (ii) the second inlet ball is located downwardly from the second inlet port; and wherein, when the fluid dispenser is in the second orientation and the second inlet ball is at the second position:

(i) the second inlet ball is located downwardly from the second outlet port, and (ii) the second inlet ball is located upwardly from the second inlet port.

In some embodiments, the pump mechanism comprises a variable volume fluid compartment that is in fluid communication with the outlet valve mechanism, the first inlet valve mechanism, and the second inlet valve mechanism;

wherein the variable volume fluid compartment has an internal volume that, upon activation of the pump mechanism, cycles between an expanded volume and a reduced volume;

wherein the fluid dispenser further comprises a one-way fluid outlet valve that allows fluid to pass from the variable volume fluid compartment, past the one-way fluid outlet valve, to the outlet valve mechanism, and prevents fluid from passing from the outlet valve mechanism, past the one-way fluid outlet valve, to the variable volume fluid compartment;

wherein the fluid dispenser further comprises at least one one-way fluid inlet valve that allows fluid to pass from the first inlet valve mechanism and the second inlet valve mechanism to the variable volume fluid compartment, and prevents fluid from passing from the variable volume fluid compartment to the first inlet valve mechanism and the second inlet valve mechanism;

wherein, when the fluid dispenser is in the first orientation and the internal volume of the variable volume fluid compartment is increased from the reduced volume to the expanded volume:

(i) a fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the first inlet valve chamber, to the variable volume fluid compartment, (iii) the engagement of the second inlet ball with the second outlet port prevents fluid from passing from the fluid reservoir, through the second inlet valve chamber, to the variable volume fluid compartment, and (iv) the one-way fluid outlet valve prevents fluid from passing from the outlet valve mechanism, past the one-way fluid outlet valve, to the variable volume fluid compartment;

wherein, when the fluid dispenser is in the first orientation and the internal volume of the variable volume fluid compartment is decreased from the expanded volume to the reduced volume:

(i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the one-way fluid inlet valve, and through the outlet valve mechanism, to be dispensed from the first fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir;

wherein, when the fluid dispenser is in the second orientation and the internal volume of the variable volume fluid compartment is increased from the reduced volume to the expanded volume:

(i) the fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the second inlet valve chamber, to the variable volume fluid compartment, (iii) the engagement of the first inlet ball with the first outlet port prevents fluid from passing from the fluid reservoir, through the first inlet valve chamber, to the variable volume fluid compartment, and (iv) the one-way fluid outlet valve prevents fluid from passing from the outlet valve mechanism, past the one-way fluid outlet valve, to the variable volume fluid compartment; and wherein, when the fluid dispenser is in the second orientation and the internal volume of the variable volume fluid compartment is decreased from the expanded volume to the reduced volume:

(i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the one-way fluid inlet valve, and through the outlet valve mechanism, to be dispensed from the second fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir.

Optionally, a weight of the first inlet ball is selected so that, when the fluid dispenser is in the first orientation and the internal volume of the variable volume fluid compartment is increased from the reduced volume to the expanded volume, the negative pressure differential between the variable volume fluid compartment and the fluid reservoir is sufficient to lift the first inlet ball away from the first inlet port to allow the fluid to pass from the fluid reservoir, through the first inlet valve chamber, to the variable volume fluid compartment;

wherein a weight of the second inlet ball is selected so that, when the fluid dispenser is in the second orientation and the internal volume of the variable volume fluid compartment is increased from the reduced volume to the expanded volume, the negative pressure differential between the variable volume fluid compartment and the fluid reservoir is sufficient to lift the second inlet ball away from the second inlet port to allow the fluid to pass from the fluid reservoir, through the second inlet valve chamber, to the variable volume fluid compartment.

Preferably, the fluid dispenser further comprises:

a first inlet passage in fluid communication with the first inlet valve mechanism and the fluid reservoir; and a second inlet passage in fluid communication with the second inlet valve mechanism and the fluid reservoir;

wherein the first inlet passage has a first passage opening for receiving the fluid from the fluid reservoir;

wherein the second inlet passage has a second passage opening for receiving the fluid from the fluid reservoir;

wherein, when the fluid dispenser is in the first orientation, the first passage opening is located below the second passage opening; and wherein, when the fluid dispenser is in the second orientation, the first passage opening is located above the second passage opening.

Optionally, the first orientation is an upright orientation and the second orientation is an inverted orientation;

wherein the first passage opening is positioned to receive the fluid from a bottom portion of the fluid reservoir; and wherein the second passage opening is positioned to receive the fluid from a top portion of the fluid reservoir.

In some preferred embodiments, the first fluid outlet comprises a nozzle that, upon activation of the pump mechanism while the fluid dispenser is in the first orientation, discharges the fluid as a stream or a spray that is directed away from the fluid dispenser.

Preferably, the fluid dispenser further comprises an application member for applying the fluid to a surface;

wherein the application member is located proximate to the second fluid outlet so that, upon activation of the pump mechanism while the fluid dispenser is in the second orientation, the second fluid outlet discharges the fluid into or adjacent to the application member.

The application member may, for example, comprise at least one of: a scrubbing tool, a wiping tool, a scraping tool, a polishing tool, a cleaning tool, a natural sponge, a synthetic sponge, a cloth, a brush, a roller applicator, and a wipe pad.

Optionally, the fluid dispenser further comprises:

a handle portion for manually carrying the fluid dispenser with a user's hand; and an actuator that is manually operable to activate the pump mechanism;

wherein the actuator is located on or proximate to the handle portion so as to be accessible for manual operation by a user's finger or fingers while gripping the handle portion with the user's hand in both the first orientation and the second orientation.

Preferably, the fluid dispenser further comprises:

a one-way air valve that allows atmospheric air to enter the fluid reservoir through the one-way air valve, and prevents fluid from exiting the fluid reservoir through the one-way air valve, when the fluid dispenser is in the first orientation and the second orientation.

Optionally, the fluid comprises a surface cleaning fluid.

In some embodiments, the movable outlet member is movably disposed within an outlet valve chamber, the outlet valve chamber having an inlet opening, a first outlet opening, and a second outlet opening; wherein the inlet opening is in fluid communication with the pump mechanism for receiving the fluid upon activation of the pump mechanism; wherein the first outlet opening is in fluid communication with the first fluid outlet; wherein the second outlet opening is in fluid communication with the second fluid outlet; wherein, when the movable outlet member is at the first position: (i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; and wherein, when the movable outlet member is at the second position: (i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening.

Optionally, the fluid dispenser further comprises an application member for applying the fluid to a surface; wherein the first fluid outlet comprises a nozzle that, upon activation of the pump mechanism while the fluid dispenser is in the first orientation, discharges the fluid as a stream or a spray that is directed away from the fluid dispenser; and wherein the application member is located proximate to the second fluid outlet so that, upon activation of the pump mechanism while the fluid dispenser is in the second orientation, the second fluid outlet discharges the fluid into or adjacent to the application member.

The fluid dispenser may, for example, further comprise: a handle portion for manually carrying the fluid dispenser with a user's hand; and an actuator that is manually operable to activate the pump mechanism; wherein the actuator is located on or proximate to the handle portion so as to be accessible for manual operation by a user's finger or fingers while gripping the handle portion with the user's hand in both the first orientation and the second orientation; and wherein the fluid comprises a surface cleaning fluid.

In some preferred embodiments, the movable outlet member is movably disposed within an outlet valve chamber, the outlet valve chamber having an inlet opening, a first outlet opening, and a second outlet opening; wherein the inlet opening is in fluid communication with the pump mechanism for receiving the fluid upon activation of the pump mechanism; wherein the first outlet opening is in fluid communication with the first fluid outlet; wherein the second outlet opening is in fluid communication with the second fluid outlet; wherein, when the movable outlet member is at the first position: (i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; wherein, when the movable outlet member is at the second position: (i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening; wherein the movable outlet member comprises an outlet ball; wherein, when the fluid dispenser is in the first orientation and the outlet ball is at the first position: (i) the outlet ball is located downwardly from the first outlet opening, and (ii) the outlet ball is located upwardly from the second outlet opening; wherein, when the fluid dispenser is in the second orientation and the outlet ball is at the second position: (i) the outlet ball is located upwardly from the first outlet opening, and (ii) the outlet ball is located downwardly from the second outlet opening; the fluid dispenser further comprising: a first inlet passage in fluid communication with the first inlet valve mechanism and the fluid reservoir; and a second inlet passage in fluid communication with the second inlet valve mechanism and the fluid reservoir; wherein the first inlet passage has a first passage opening for receiving the fluid from the fluid reservoir; wherein the second inlet passage has a second passage opening for receiving the fluid from the fluid reservoir; wherein, when the fluid dispenser is in the first orientation, the first passage opening is located below the second passage opening; wherein, when the fluid dispenser is in the second orientation, the first passage opening is located above the second passage opening; wherein the first orientation is an upright orientation and the second orientation is an inverted orientation; wherein the first passage opening is positioned to receive the fluid from a bottom portion of the fluid reservoir; wherein the second passage opening is positioned to receive the fluid from a top portion of the fluid reservoir; the fluid dispenser further comprising an application member for applying the fluid to a surface; wherein the first fluid outlet comprises a nozzle that, upon activation of the pump mechanism while the fluid dispenser is in the first orientation, discharges the fluid as a stream or a spray that is directed away from the fluid dispenser; wherein the application member is located proximate to the second fluid outlet so that, upon activation of the pump mechanism while the fluid dispenser is in the second orientation, the second fluid outlet discharges the fluid into or adjacent to the application member; the fluid dispenser further comprising: a handle portion for manually carrying the fluid dispenser with a user's hand; and an actuator that is manually operable to activate the pump mechanism; wherein the actuator is located on or proximate to the handle portion so as to be accessible for manual operation by a user's finger or fingers while gripping the handle portion with the user's hand in both the first orientation and the second orientation; and wherein the fluid comprises a surface cleaning fluid.

In another aspect, the present invention resides in a fluid dispenser comprising: a fluid reservoir containing a fluid to be dispensed; a first fluid outlet for dispensing the fluid when the fluid dispenser is in a first orientation; a second fluid outlet for dispensing the fluid when the fluid dispenser is in a second orientation; an outlet valve mechanism for directing the fluid towards the first fluid outlet when the fluid dispenser is in the first orientation, and towards the second fluid outlet when the fluid dispenser is in the second orientation; and a pump mechanism that, when activated, forces an allotment of the fluid through the outlet valve mechanism to be discharged from either the first fluid outlet or the second fluid outlet; wherein the outlet valve mechanism comprises a movable outlet member that is located at a first position when the fluid dispenser is in the first orientation, and is located at a second position when the fluid dispenser is in the second orientation; wherein the movable outlet member moves from the first position to the second position under the force of gravity when the fluid dispenser moves from the first orientation to the second orientation; wherein the movable outlet member moves from the second position to the first position under the force of gravity when the fluid dispenser moves from the second orientation to the first orientation; wherein, when the movable outlet member is at the first position, the outlet valve mechanism allows the fluid to pass through the outlet valve mechanism towards the first fluid outlet, and prevents the fluid from passing through the outlet valve mechanism towards the second fluid outlet; and wherein, when the movable outlet member is at the second position, the outlet valve mechanism allows the fluid to pass through the outlet valve mechanism towards the second fluid outlet, and prevents the fluid from passing through the outlet valve mechanism towards the first fluid outlet.

Preferably, the movable outlet member is movably disposed within an outlet valve chamber, the outlet valve chamber having an inlet opening, a first outlet opening, and a second outlet opening; wherein the inlet opening is in fluid communication with the pump mechanism for receiving the fluid upon activation of the pump mechanism; wherein the first outlet opening is in fluid communication with the first fluid outlet; wherein the second outlet opening is in fluid communication with the second fluid outlet; wherein, when the movable outlet member is at the first position: (i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; and wherein, when the movable outlet member is at the second position: (i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening.

In some embodiments, the movable outlet member comprises an outlet ball; wherein, when the fluid dispenser is in the first orientation and the outlet ball is at the first position: (i) the outlet ball is located downwardly from the first outlet opening, and (ii) the outlet ball is located upwardly from the second outlet opening; and wherein, when the fluid dispenser is in the second orientation and the outlet ball is at the second position: (i) the outlet ball is located upwardly from the first outlet opening, and (ii) the outlet ball is located downwardly from the second outlet opening.

The fluid dispenser may, for example, further comprise: a first inlet valve mechanism for delivering the fluid from the fluid reservoir to the pump mechanism when the fluid dispenser is in the first orientation; and a second inlet valve mechanism for delivering the fluid from the fluid reservoir to the pump mechanism when the fluid dispenser is in the second orientation; wherein the first inlet valve mechanism comprises a first movable inlet member that is located at a first position when the fluid dispenser is in the first orientation, and is located at a second position when the fluid dispenser is in the second orientation; wherein the first movable inlet member moves from the first position to the second position under the force of gravity when the fluid dispenser moves from the first orientation to the second orientation; wherein the first movable inlet member moves from the second position to the first position under the force of gravity when the fluid dispenser moves from the second orientation to the first orientation; wherein, when the first movable inlet member is at the first position, the first inlet valve mechanism allows fluid to pass from the fluid reservoir, through the first inlet valve mechanism, to the pump mechanism; wherein, when the first movable inlet member is at the second position, the first inlet valve mechanism prevents fluid from passing from the fluid reservoir, through the first inlet valve mechanism, to the pump mechanism; wherein the second inlet valve mechanism comprises a second movable inlet member that is located at a first position when the fluid dispenser is in the first orientation, and is located at a second position when the fluid dispenser is in the second orientation; wherein the second movable inlet member moves from the first position to the second position under the force of gravity when the fluid dispenser moves from the first orientation to the second orientation; wherein the second movable inlet member moves from the second position to the first position under the force of gravity when the fluid dispenser moves from the second orientation to the first orientation; wherein, when the second movable inlet member is at the first position, the second inlet valve mechanism prevents fluid from passing from the fluid reservoir, through the second inlet valve mechanism, to the pump mechanism; and wherein, when the second movable inlet member is at the second position, the second inlet valve mechanism allows fluid to pass from the fluid reservoir, through the second inlet valve mechanism, to the pump mechanism.

In some embodiments, the first movable inlet member is movably disposed within a first inlet valve chamber, the first inlet valve chamber having a first inlet port and a first outlet port; wherein the first inlet port is in fluid communication with the fluid reservoir; wherein the first outlet port is in fluid communication with the pump mechanism; wherein, when the first movable inlet member is at the first position, the first movable inlet member is spaced from the first outlet port and engages with the first inlet port, and allows fluid to pass from the fluid reservoir, through the first inlet valve chamber, to the pump mechanism; wherein, when the first movable inlet member is at the second position, the first movable inlet member is spaced from the first inlet port and engages with the first outlet port to prevent fluid from passing from the fluid reservoir, through the first inlet valve chamber, to the pump mechanism; wherein the second movable inlet member is movably disposed within a second inlet valve chamber, the second inlet valve chamber having a second inlet port and a second outlet port; wherein the second inlet port is in fluid communication with the fluid reservoir; wherein the second outlet port is in fluid communication with the pump mechanism; wherein, when the second movable inlet member is at the first position, the second movable inlet member is spaced from the second inlet port and engages with the second outlet port to prevent fluid from passing from the fluid reservoir, through the second inlet valve chamber, to the pump mechanism; and wherein, when the second movable inlet member is at the second position, the second movable inlet member is spaced from the second outlet port and engages with the second inlet port, and allows fluid to pass from the fluid reservoir, through the second inlet valve chamber, to the pump mechanism.

Optionally, the first movable inlet member comprises a first inlet ball; wherein, when the fluid dispenser is in the first orientation and the first inlet ball is at the first position: (i) the first inlet ball is located downwardly from the first outlet port, and (ii) the first inlet ball is located upwardly from the first inlet port; wherein, when the fluid dispenser is in the second orientation and the first inlet ball is at the second position: (i) the first inlet ball is located upwardly from the first outlet port, and (ii) the first inlet ball is located downwardly from the first inlet port; wherein the second movable inlet member comprises a second inlet ball; wherein, when the fluid dispenser is in the first orientation and the second inlet ball is at the first position: (i) the second inlet ball is located upwardly from the second outlet port, and (ii) the second inlet ball is located downwardly from the second inlet port; and wherein, when the fluid dispenser is in the second orientation and the second inlet ball is at the second position: (i) the second inlet ball is located downwardly from the second outlet port, and (ii) the second inlet ball is located upwardly from the second inlet port.

Preferably, the pump mechanism comprises a variable volume fluid compartment that is in fluid communication with the outlet valve mechanism, the first inlet valve mechanism, and the second inlet valve mechanism; wherein the variable volume fluid compartment has an internal volume that, upon activation of the pump mechanism, cycles between an expanded volume and a reduced volume; wherein the fluid dispenser further comprises a one-way fluid outlet valve that allows fluid to pass from the variable volume fluid compartment, past the one-way fluid outlet valve, to the outlet valve mechanism, and prevents fluid from passing from the outlet valve mechanism, past the one-way fluid outlet valve, to the variable volume fluid compartment; wherein the fluid dispenser further comprises at least one one-way fluid inlet valve that allows fluid to pass from the first inlet valve mechanism and the second inlet valve mechanism to the variable volume fluid compartment, and prevents fluid from passing from the variable volume fluid compartment to the first inlet valve mechanism and the second inlet valve mechanism; wherein, when the fluid dispenser is in the first orientation and the internal volume of the variable volume fluid compartment is increased from the reduced volume to the expanded volume: (i) a fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the first inlet valve chamber, to the variable volume fluid compartment, (iii) the engagement of the second inlet ball with the second outlet port prevents fluid from passing from the fluid reservoir, through the second inlet valve chamber, to the variable volume fluid compartment, and (iv) the one-way fluid outlet valve prevents fluid from passing from the outlet valve mechanism, past the one-way fluid outlet valve, to the variable volume fluid compartment; wherein, when the fluid dispenser is in the first orientation and the internal volume of the variable volume fluid compartment is decreased from the expanded volume to the reduced volume: (i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the at least one one-way fluid inlet valve, and through the outlet valve mechanism, to be dispensed from the first fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir; wherein, when the fluid dispenser is in the second orientation and the internal volume of the variable volume fluid compartment is increased from the reduced volume to the expanded volume: (i) the fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the second inlet valve chamber, to the variable volume fluid compartment, (iii) the engagement of the first inlet ball with the first outlet port prevents fluid from passing from the fluid reservoir, through the first inlet valve chamber, to the variable volume fluid compartment, and (iv) the one-way fluid outlet valve prevents fluid from passing from the outlet valve mechanism, past the one-way fluid outlet valve, to the variable volume fluid compartment; and wherein, when the fluid dispenser is in the second orientation and the internal volume of the variable volume fluid compartment is decreased from the expanded volume to the reduced volume: (i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the at least one one-way fluid inlet valve, and through the outlet valve mechanism, to be dispensed from the second fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir.

Optionally, a weight of the first inlet ball is selected so that, when the fluid dispenser is in the first orientation and the internal volume of the variable volume fluid compartment is increased from the reduced volume to the expanded volume, the negative pressure differential between the variable volume fluid compartment and the fluid reservoir is sufficient to lift the first inlet ball away from the first inlet port to allow the fluid to pass from the fluid reservoir, through the first inlet valve chamber, to the variable volume fluid compartment; wherein a weight of the second inlet ball is selected so that, when the fluid dispenser is in the second orientation and the internal volume of the variable volume fluid compartment is increased from the reduced volume to the expanded volume, the negative pressure differential between the variable volume fluid compartment and the fluid reservoir is sufficient to lift the second inlet ball away from the second inlet port to allow the fluid to pass from the fluid reservoir, through the second inlet valve chamber, to the variable volume fluid compartment.

The fluid dispenser may, for example, further comprise: a first inlet passage in fluid communication with the first inlet valve mechanism and the fluid reservoir; and a second inlet passage in fluid communication with the second inlet valve mechanism and the fluid reservoir; wherein the first inlet passage has a first passage opening for receiving the fluid from the fluid reservoir; wherein the second inlet passage has a second passage opening for receiving the fluid from the fluid reservoir; wherein, when the fluid dispenser is in the first orientation, the first passage opening is located below the second passage opening; and wherein, when the fluid dispenser is in the second orientation, the first passage opening is located above the second passage opening.

Optionally, the first orientation is an upright orientation and the second orientation is an inverted orientation; wherein the first passage opening is positioned to receive the fluid from a bottom portion of the fluid reservoir; and wherein the second passage opening is positioned to receive the fluid from a top portion of the fluid reservoir.

In some embodiments, the first fluid outlet comprises a nozzle that, upon activation of the pump mechanism while the fluid dispenser is in the first orientation, discharges the fluid as a stream or a spray that is directed away from the fluid dispenser.

The fluid dispenser may, for example, further comprise an application member for applying the fluid to a surface; wherein the application member is located proximate to the second fluid outlet so that, upon activation of the pump mechanism while the fluid dispenser is in the second orientation, the second fluid outlet discharges the fluid into or adjacent to the application member.

The application member may, for example, comprise at least one of: a scrubbing tool, a wiping tool, a scraping tool, a polishing tool, a cleaning tool, a natural sponge, a synthetic sponge, a cloth, a brush, a roller applicator, and a wipe pad.

In some embodiments, the fluid dispenser further comprises: a handle portion for manually carrying the fluid dispenser with a user's hand; and an actuator that is manually operable to activate the pump mechanism; wherein the actuator is located on or proximate to the handle portion so as to be accessible for manual operation by a user's finger or fingers while gripping the handle portion with the user's hand in both the first orientation and the second orientation; and wherein the fluid comprises a surface cleaning fluid.

Optionally, the fluid dispenser further comprises a one-way air valve that allows atmospheric air to enter the fluid reservoir through the one-way air valve, and prevents fluid from exiting the fluid reservoir through the one-way air valve, when the fluid dispenser is in the first orientation and the second orientation.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
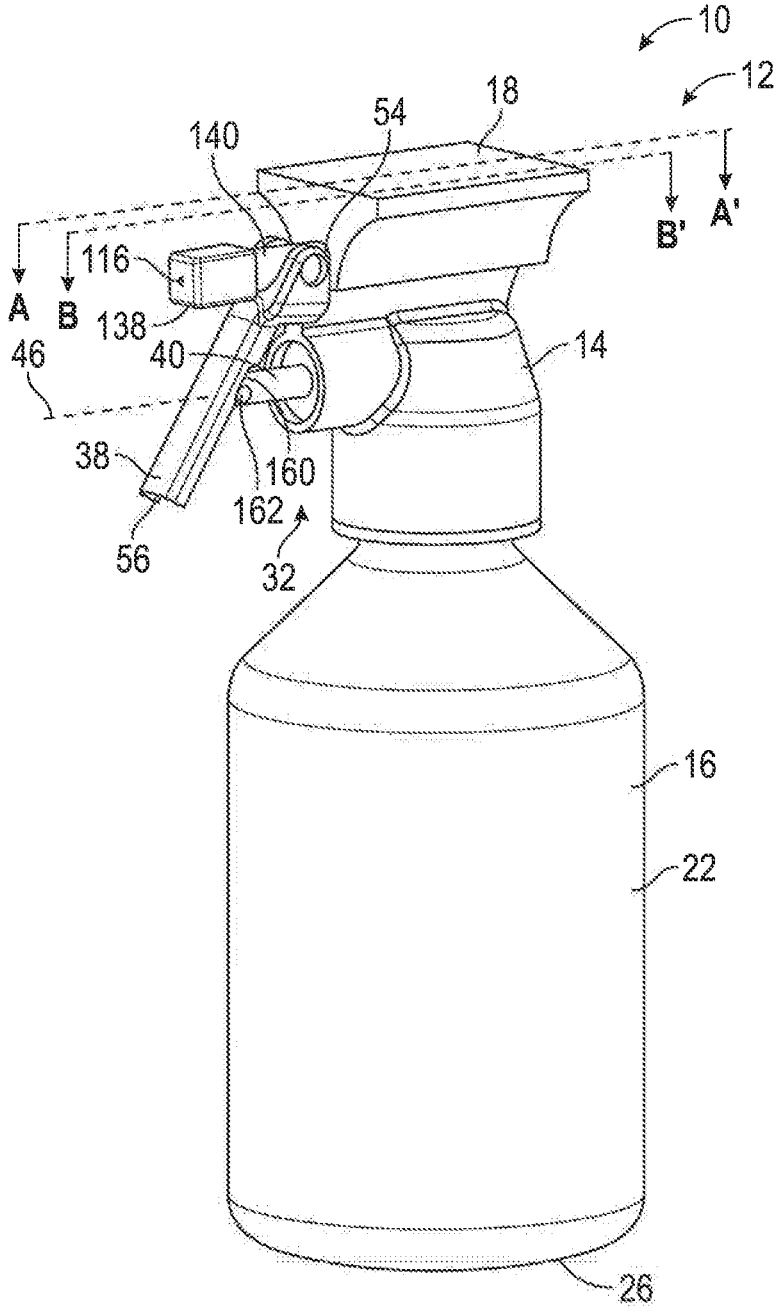
FIG. 1 is a perspective view of a fluid dispenser in accordance with a first embodiment of the present invention.
Figure 2:
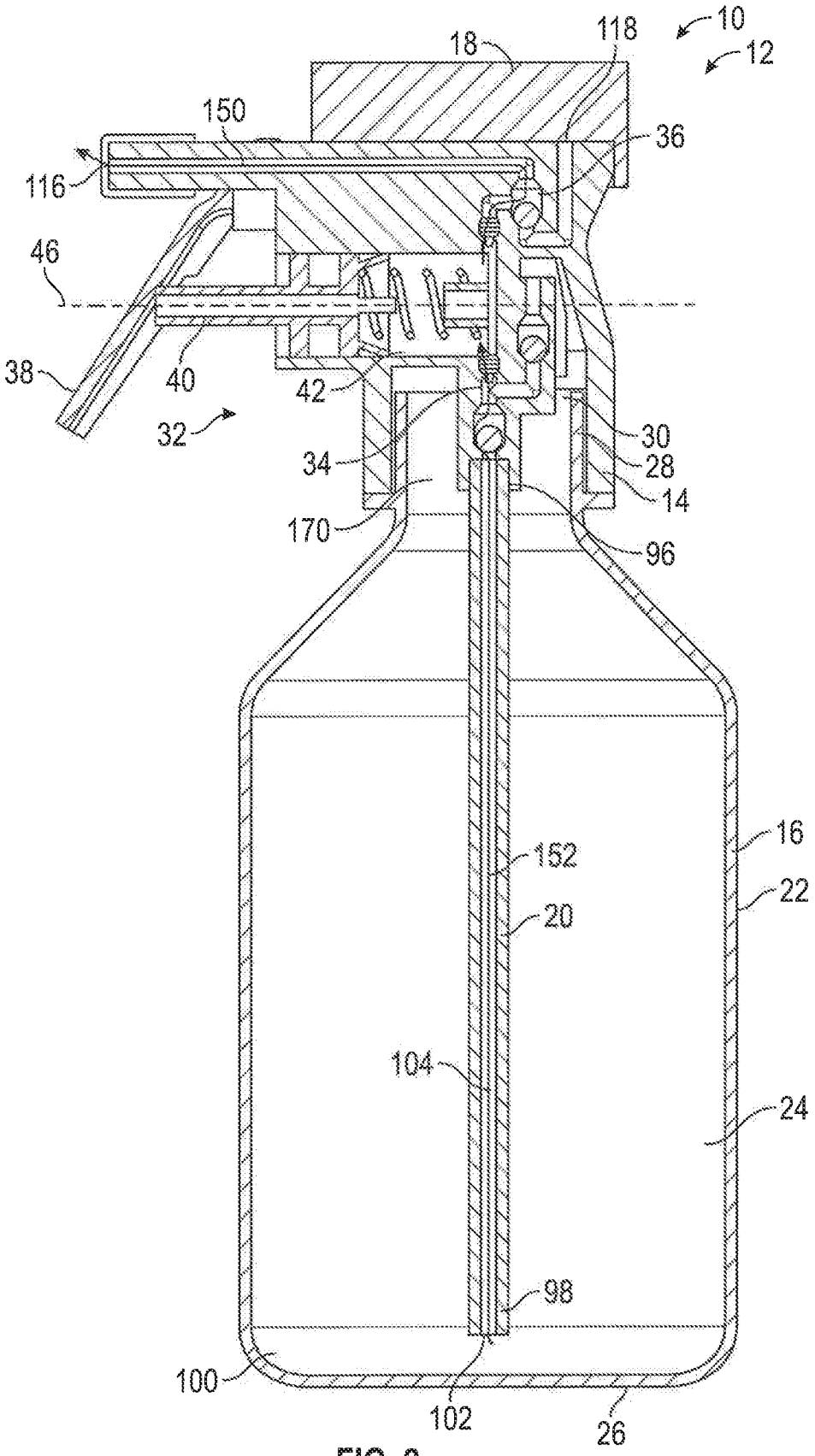
FIG. 2 is a cross-sectional view of the fluid dispenser shown in FIG. 1, taken along line A-A' in FIG. 1, with the fluid dispenser in an upright orientation.

FIGS. 1 and 2 show a fluid dispenser 10 in accordance with a first embodiment of the present invention. The fluid dispenser 10 is a hand held spray bottle 12, and includes a spray handle portion 14, a fluid reservoir 16, an application member 18, and a dip tube 20.

As shown in FIGS. 1 and 2, the fluid reservoir 16 is a bottle with an outer wall 22 that defines an internal fluid chamber 24. The internal fluid chamber 24 contains a cleaning fluid, not shown, that is to be dispensed from the fluid dispenser 10. The fluid reservoir 16 has a flat bottom surface 26 that can support the dispenser 10 on an upwardly facing support surface, such as a counter top or a floor, in the upright orientation shown in FIG. 1. The top or top portion 170 of the fluid reservoir 16 has a neck portion 28 with an upwardly open end 30. The neck portion 28 sealingly engages with and supports the spray handle portion 14.

Figure 3A:
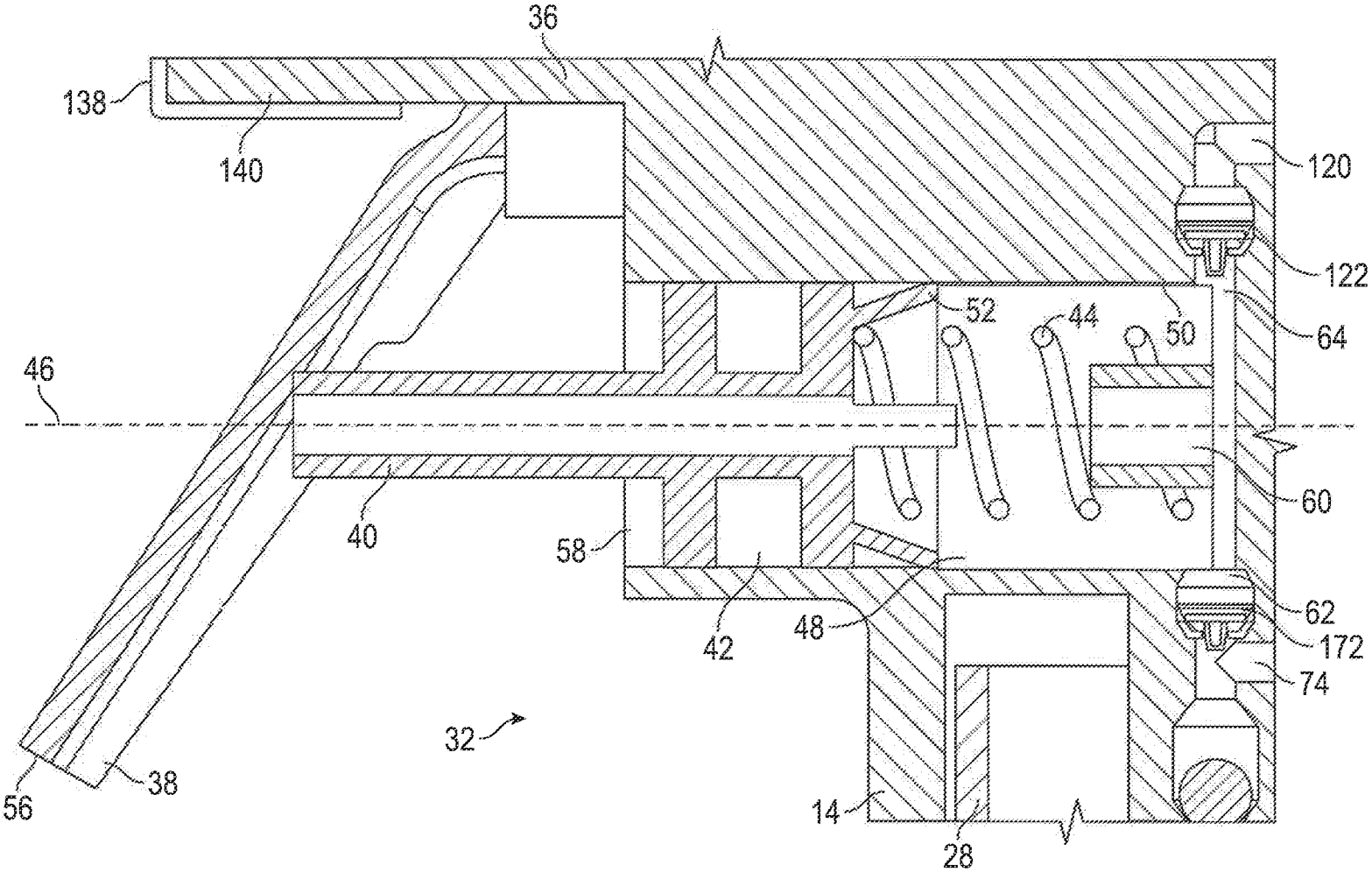
FIG. 3A is an enlarged cross-sectional view of a pump mechanism of the fluid dispenser shown in FIG. 2, with the fluid dispenser in the upright orientation.

The spray handle portion 14 includes a pump mechanism 32, an inlet portion 34, and an outlet portion 36. The pump mechanism 32 is show in FIG. 3A, and includes a trigger actuator 38, a piston 40, a piston chamber 42, and a spring 44. The piston chamber 42 is defined by a cylindrical chamber surface 50, and is open at a front end 58 of the chamber 42 for receiving the piston 40. The piston 40 is reciprocally slidable relative to the piston chamber 42 along a pump axis 46, and has a sealing disc 52 that sealingly engages with the cylindrical chamber surface 50. A variable volume fluid compartment 48 is defined between the sealing disc 52 and the chamber surface 50. A compartment inlet 62 and a compartment outlet 64 for receiving and expelling fluid from the variable volume fluid compartment 48, respectively, are provided at a back end 60 of the piston chamber 42.

The trigger 38 extends from an attachment end 54 to a distal end 56. The attachment end 54 is pivotally mounted to the outlet portion 36 of the spray handle 14, allowing the trigger 38 to pivot from the unbiased position shown in FIG. 3A to a biased position, not shown, in which the distal end 56 of the trigger 38 is pivoted rearwardly towards the piston chamber 42. The trigger 38 has a rearwardly facing piston engagement recess 160, and the piston has a trigger engagement pin 162 that is received by and engages with the piston engagement recess 160, as can be seen in FIG. 1. When the trigger 38 is moved from the unbiased position to the biased position, the engagement of the piston engagement recess 160 with the trigger engagement pin 162 slides the piston 40 axially inwardly relative to the piston chamber 42 from the extended position shown in FIG. 3A to a retracted position, not shown, in which the sealing disc 52 is moved rearwardly closer to the back end 60 of the piston chamber 42. Movement of the piston 40 from the extended position to the retracted position reduces the volume of the variable volume fluid compartment 48, and movement of the piston 40 from the retracted position to the extended position increases the volume of the variable volume fluid compartment 48. The spring 44 extends between the sealing disc 52 and the back end 60 of the piston chamber 42, and biases the piston 40 towards the extended position.

Figure 3B:
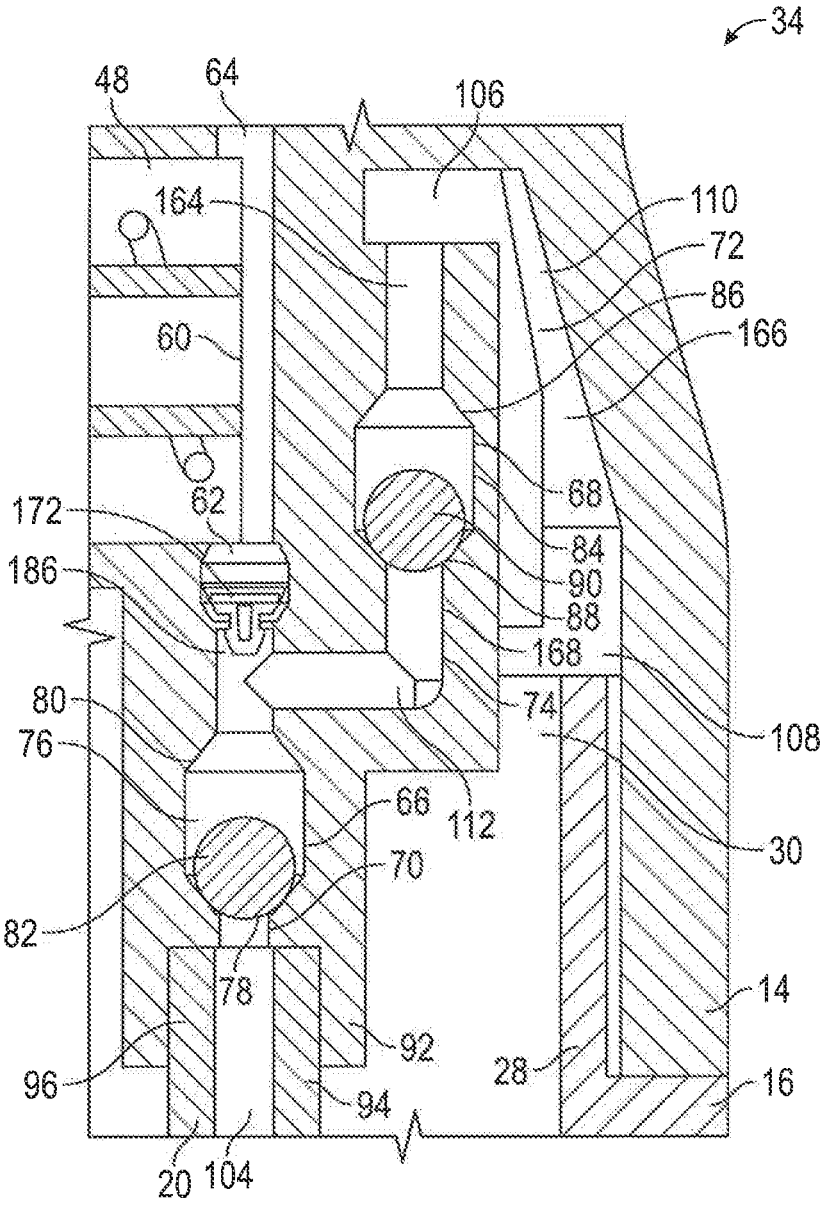
FIG. 3B is an enlarged cross-sectional view of an inlet portion of the fluid dispenser shown in FIG. 2, with the fluid dispenser in the upright orientation.
Figure 4:
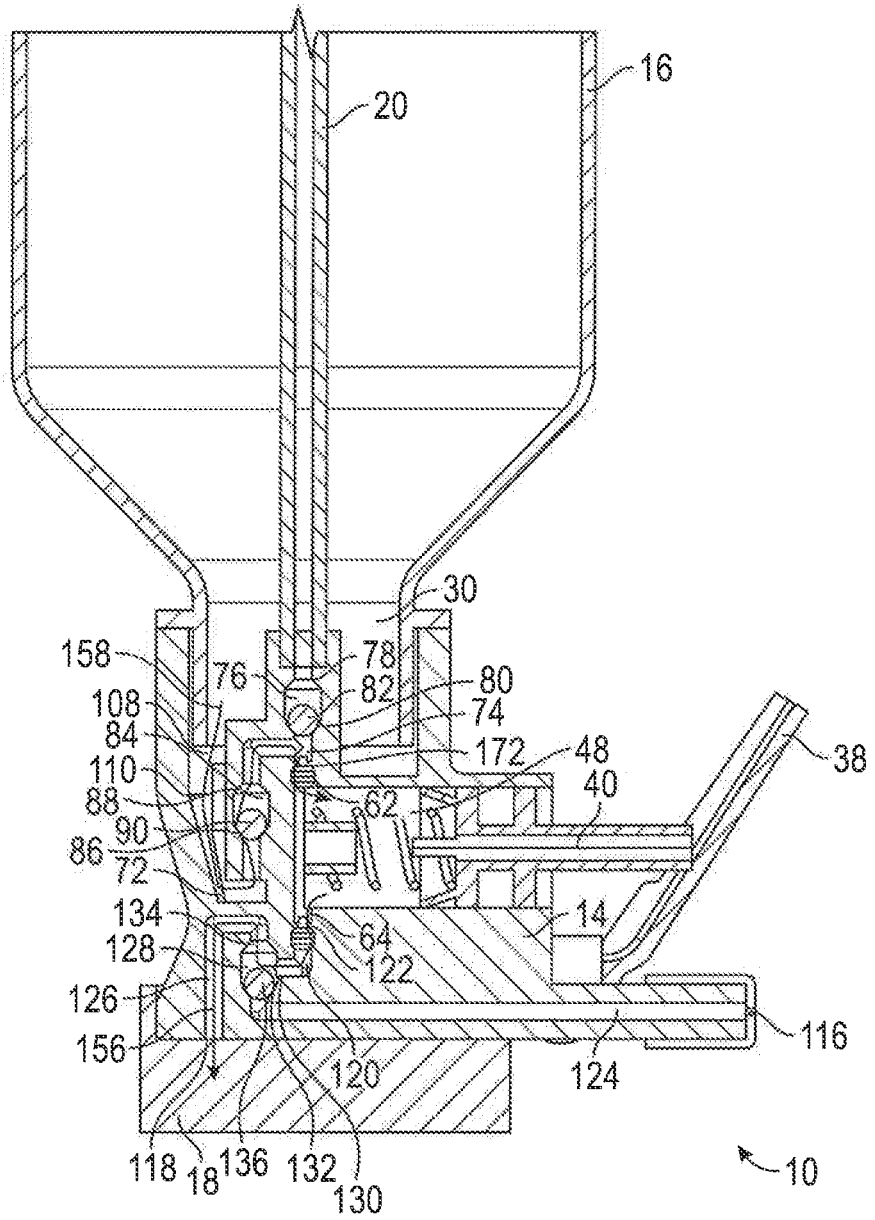
FIG. 4 is an enlarged cross-sectional view of a spray handle portion of the fluid dispenser shown in FIG. 2, with the fluid dispenser in an inverted orientation.

The inlet portion 34 of the spray handle 14 is shown in FIG. 3B and includes a first inlet valve mechanism 66, a second inlet valve mechanism 68, a first fluid receiving channel 70, a second fluid receiving channel 72, a fluid inlet delivery channel 74, and a one-way fluid inlet valve 172. The first inlet valve mechanism 66 includes a first inlet valve chamber 76 having a first inlet port 78 and a first outlet port 80, and a first inlet ball 82 that is moveably received within the first inlet valve chamber 76. The first inlet ball 82 is also referred to herein as the first movable inlet member 82. When in the upright orientation as shown in FIG. 3B, the first inlet port 78 is positioned downwardly relative to the first outlet port 80, and the first inlet ball 82 engages with the first inlet port 78 and is spaced from the first outlet port 80. When in the inverted orientation as shown in FIG. 4, the first inlet port 78 is positioned upwardly relative to the first outlet port 80, and the first inlet ball 82 engages with the first outlet port 80 and is spaced from the first inlet port 78. The first inlet ball 82 moves from the first position shown in FIG. 3B to the second position shown in FIG. 4 under the force of gravity when the dispenser 10 is inverted, and moves back to the first position under the force of gravity when the dispenser 10 is returned to the upright orientation.

The second inlet valve mechanism 68 similarly includes a second inlet valve chamber 84 having a second inlet port 86 and a second outlet port 88, and a second inlet ball 90 that is moveably received within the second inlet valve chamber 94. The second inlet ball 90 is also referred to herein as the second movable inlet member 90. When in the upright orientation as shown in FIG. 3B, the second inlet port 86 is positioned upwardly relative to the second outlet port 88, and the second inlet ball 90 engages with the second outlet port 88 and is spaced from the second inlet port 86. When in the inverted orientation as shown in FIG. 4, the second inlet port 86 is positioned downwardly relative to the second outlet port 88, and the second inlet ball 90 engages with the second inlet port 86 and is spaced from the second outlet port 88. The second inlet ball 90 moves from the first position shown in FIG. 3B to the second position shown in FIG. 4 under the force of gravity when the dispenser 10 is inverted, and moves back to the first position under the force of gravity when the dispenser 10 is returned to the upright orientation.

The first fluid receiving channel 70 extends downwardly from the first inlet port 78, and has a cylindrical outer wall 92 that defines a dip tube receiving cavity 94. A top end 96 of the dip tube 20 is received within the dip tube receiving cavity 94. The dip tube 20 extends downwardly from the top end 96 to a bottom end 98 that is positioned in a bottom part or bottom portion 100 of the fluid reservoir 16 near the bottom surface 26, as shown in FIG. 2. The bottom end 98 of the dip tube 20 has a first passage opening 102 for receiving fluid from the bottom part 100 of the fluid reservoir 16. A first inlet passage 104 for delivering fluid from the first passage opening 102 to the first inlet port 78 is defined by the dip tube 20 and the first fluid receiving channel 70.

The second fluid receiving channel 72 is a generally U-shaped channel that has a first vertical side portion 164 that extends upwardly from the second inlet port 86 to a top portion 106, and a second vertical side portion 166 that extends downwardly from the top portion 106 to the open end 30 of the fluid reservoir 16. The second fluid receiving channel 72 has a second passage opening 108 where the second fluid receiving channel 72 meets the open end 30 of the fluid reservoir 16. The second fluid receiving channel 72 defines a second inlet passage 110 for delivering fluid from the open end 30 of the fluid reservoir 16 to the second inlet port 86.

The fluid inlet delivery channel 74 is a generally U-shaped channel that has a first vertical channel portion 168 that extends downwardly from the second outlet port 88 to a bottom portion 112, and a second vertical channel portion 186 that extends upwardly from the bottom portion 112 to the compartment inlet 62 of the variable volume fluid compartment 48. The first outlet port 80 also opens into the bottom portion 112 of the fluid inlet delivery channel 74, as shown in FIG. 3B. The fluid inlet delivery channel 74 delivers fluid from both the first inlet valve mechanism 66 and the second inlet valve mechanism 68 to the variable volume fluid compartment 48. The one-way fluid inlet valve 172 is positioned in the second vertical channel portion 186 of the fluid inlet delivery channel 74. The one-way fluid inlet valve 172 allows fluid to pass from the fluid inlet delivery channel 74 to the compartment inlet 62 of the variable volume fluid compartment 48, and prevents fluid from passing from the variable volume fluid compartment 48 into the fluid inlet delivery channel 74.

Figure 3C:
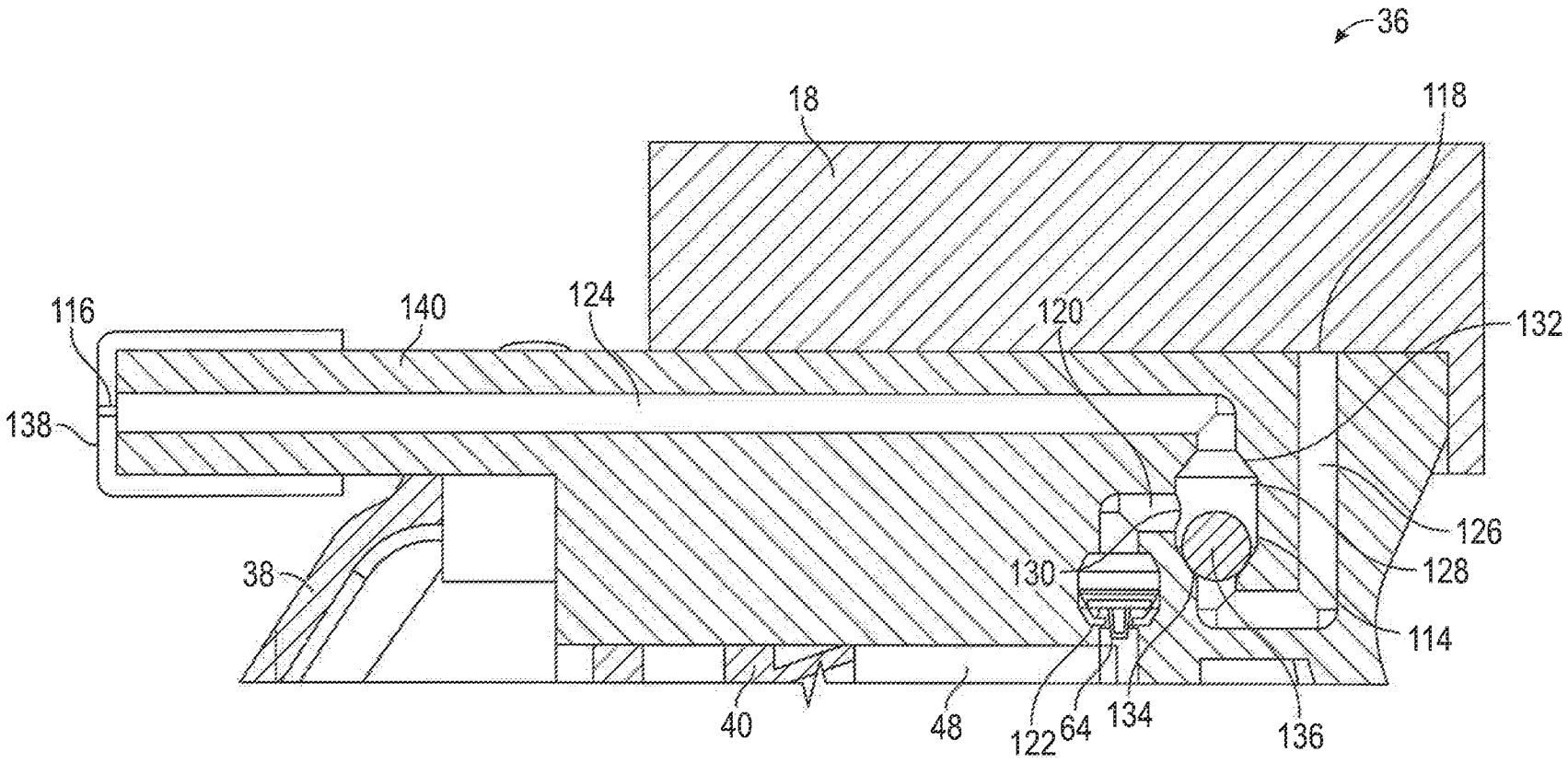
FIG. 3C is an enlarged cross-sectional view of an outlet portion of the fluid dispenser shown in FIG. 2, with the fluid dispenser in the upright orientation.

The outlet portion 36 of the spray handle 14 is shown in FIG. 3C and includes an outlet valve mechanism 114, a first fluid outlet 116, a second fluid outlet 118, an outlet fluid receiving channel 120, a one-way fluid outlet valve 122, a first outlet delivery channel 124, and a second outlet delivery channel 126. The first fluid outlet 116 is also referred to herein as the nozzle 116. The outlet valve mechanism 114 includes an outlet valve chamber 128 having an inlet opening 130, a first outlet opening 132, and a second outlet opening 134, and an outlet ball 136 that is moveably received within the outlet valve chamber 128. The outlet ball 136 is also referred to herein as the movable outlet member 136. When in the upright orientation as shown in FIG. 3C, the first outlet opening 132 is positioned upwardly relative to the second outlet opening 134, and the outlet ball 136 engages with the second outlet opening 134. When in the inverted orientation as shown in FIG. 4, the first outlet opening 132 is positioned downwardly relative to the second outlet opening 134, and the outlet ball 136 engages with the first outlet opening 132. The outlet ball 136 moves from the first position shown in FIG. 3C to the second position shown in FIG. 4 under the force of gravity when the dispenser 10 is inverted, and moves back to the first position under the force of gravity when the dispenser 10 is returned to the upright orientation.

The outlet fluid receiving channel 120 extends from the compartment outlet 64 of the piston chamber 42 to the inlet opening 130 of the outlet valve mechanism 114. The one-way fluid outlet valve 122 is positioned within the outlet fluid receiving channel 120, and allows fluid to flow from the compartment outlet 64 through the outlet fluid receiving channel 120 to the inlet opening 130, and prevents fluid from flowing from the inlet opening 130 through the outlet fluid receiving channel 120 to the compartment outlet 64.

The first outlet delivery channel 124 extends from the first outlet opening 132 to the first fluid outlet 116. The first fluid outlet 116 is located at a terminal end 138 of an outlet tube 140 of the spray handle 14. The outlet tube 140 is positioned above the trigger 38, with the terminal end 138 facing forwardly. The first fluid outlet 116 or nozzle 116 is preferably selected to discharge the fluid received from the first fluid outlet delivery channel 124 as a stream, spray, or mist that is directed forwardly, away from the dispenser 10. Optionally, the nozzle 116 may be configured to generate a foam spray by mixing the fluid with air as the fluid passes through the nozzle 116.

The second outlet delivery channel 126 extends from the second outlet opening 134 to the second fluid outlet 118. The second fluid outlet 118 is located at the top of the spray handle 14, and opens into the application member 18. The application member 18 is a soft, synthetic sponge formed from an absorbent, porous material such as polyurethane foam. The application member 18 is attached to the top of the spray handle 14.

Figure 5:
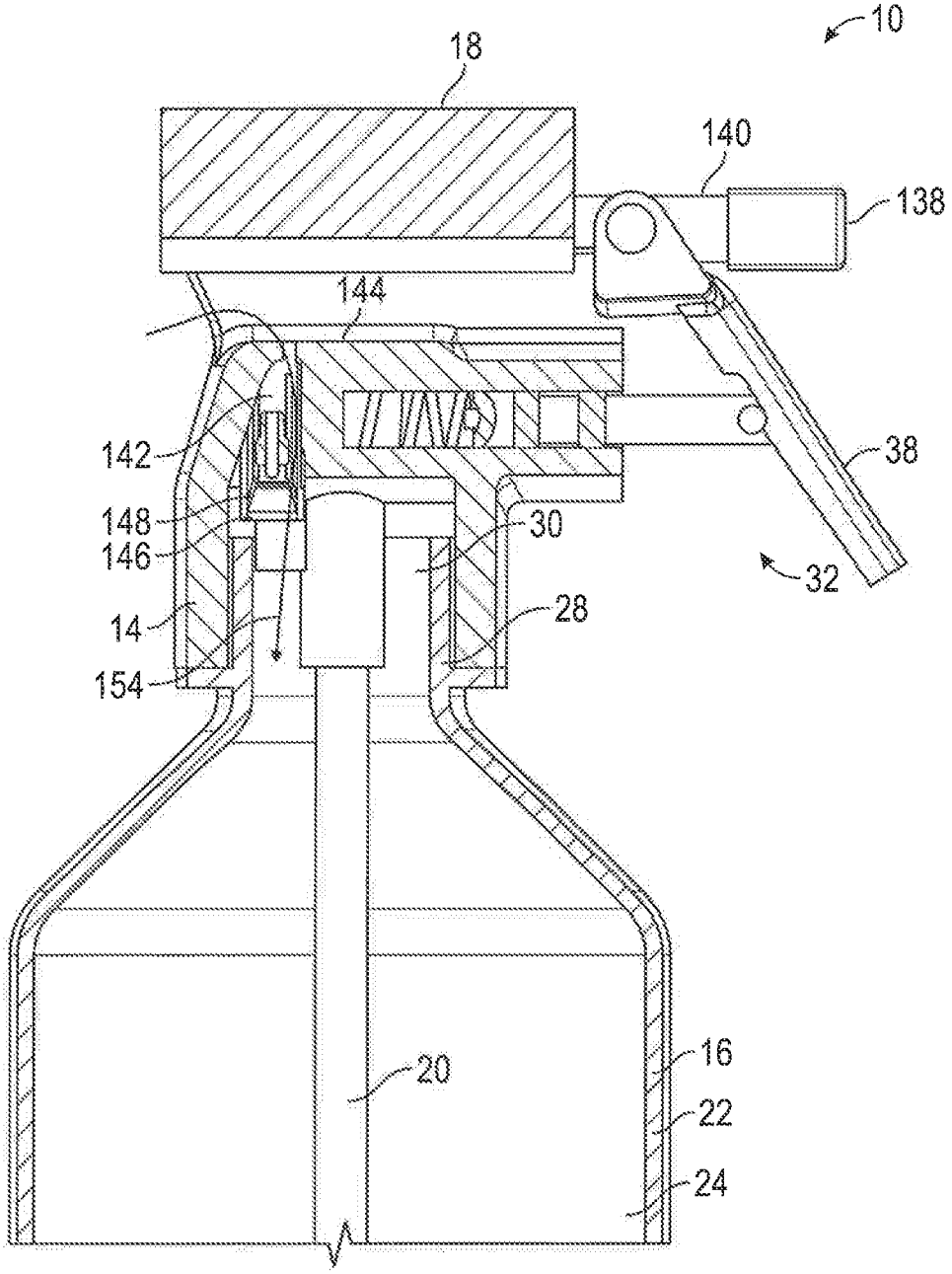
FIG. 5 is an enlarged cross-sectional view of the spray handle portion of the fluid dispenser shown in FIG. 1, taken along line B-B' in FIG. 1.

As shown in FIG. 5, the spray handle 14 also include an air vent channel 142 that extends from an air intake opening 144 to an air output opening 146. The air intake opening 144 is open to the atmosphere, and the air output opening 146 is open to the open end 30 of the fluid reservoir 16. A one-way air valve 148 is positioned within the air vent channel 142. The one-way air valve 148 opens when the fluid pressure within the fluid reservoir 16 falls below a threshold vacuum pressure to allow atmospheric air to pass from the air intake opening 146 through the air vent channel 142 and into the fluid reservoir 16 via the air output opening 146. When the fluid pressure within the fluid reservoir 16 is above the threshold minimum vacuum pressure, the one-way air valve 148 closes to prevent the fluid within the fluid reservoir 16 from passing through the air vent channel 142 and out the air intake opening 146.

The operation of the fluid dispenser 10 will now be described with reference to FIGS. 1 to 5. The fluid dispenser 10 is used to clean or disinfect a surface such as a table top, a counter, or a floor. The fluid reservoir 16 is filled with a cleaning fluid such as a liquid detergent or disinfectant. The cleaning fluid can be dispensed from either the first fluid outlet 116 as a stream, or from the second fluid outlet via the application member 18. To dispense the cleaning fluid, the dispenser 10 is first picked up with a user's hand by grasping the spray handle 14, and is carried to the surface in need of cleaning. To dispense the fluid as a stream from the first fluid outlet 116, the dispenser 10 is held in the upright orientation as shown in FIGS. 1, 2, 3A, 3B, and 3C, and one or more of the user's fingers are used to pull the trigger 38 axially inwardly towards the piston chamber 42. This forces the piston 40 to slide axially inwardly relative to the piston chamber 42 from the extended position to the retracted position, reducing the volume of the variable volume fluid compartment 48. As the volume of the fluid compartment 48 decreases, the fluid pressure within the variable volume fluid compartment 48 increases, generating a positive pressure differential between the variable volume fluid compartment 48 and the atmospheric air surrounding the dispenser 10, which causes the fluid within the variable volume fluid compartment 48 to flow outwardly through the compartment outlet 62, past the one-way fluid outlet valve 122, and through the outlet fluid receiving channel 120 to the inlet opening 130 of the outlet valve chamber 128.

If the dispenser 10 is in the upright orientation before the trigger 38 is pulled, under gravity the outlet ball 136 engages with the second outlet opening 134, as shown in FIG. 3C. The engagement of the outlet ball 136 with the second outlet opening 134 prevents the fluid received from the inlet opening 130 when the trigger 38 is pulled from passing into the second outlet opening 134 towards the second fluid outlet 118. The fluid that is received from the inlet opening 130 also increases the fluid pressure within the outlet valve chamber 128, which further urges the outlet ball 136 into engagement with the second outlet opening 134. The outlet ball 136 is spaced from the first outlet opening 132, providing a passageway for the fluid received from the inlet opening 130 to pass through the outlet valve chamber 128 into the first outlet opening 132. The fluid received by the first outlet opening 132 passes through the first outlet delivery channel 124 to the first fluid outlet 116, and is discharged from the first fluid outlet 116 as a stream directed forwardly, away from the dispenser 10. The stream of fluid can, for example, be discharged onto the surface in need of cleaning by directing the terminal end 138 of the outlet tube 140 towards the surface, with the dispenser 10 in the upright orientation, and pulling the trigger 38. The path the fluid takes from the variable volume fluid compartment 48 to the first fluid outlet 116 is shown in FIG. 2 by the arrow 150.

When the trigger 38 is pulled while in the upright orientation as shown in FIGS. 1, 2, 3A, 3B, and 3C, the one-way fluid inlet valve 172 prevents the fluid from flowing from the variable volume fluid compartment 48 into the fluid inlet delivery channel 74.

When the trigger 38 is released by the user's fingers, the spring 44 pushes the piston 40 axially outwardly relative to the piston chamber 42 from the retracted position back to the extended position. This increases the volume of the variable volume fluid compartment 48, reducing the fluid pressure within the variable volume fluid compartment 48 and generating a negative pressure differential between the variable volume fluid compartment 48 and the fluid reservoir 16. The negative pressure differential causes the relatively higher pressure fluid within the fluid reservoir 16 to pass from the fluid reservoir 16 into the variable volume fluid compartment 48. In particular, the fluid pooled by the force of gravity in the bottom portion 112 of the fluid reservoir 16 is drawn into the first passage opening 102 at the bottom end 98 of the dip tube 20, passes through the first inlet passage 104 to the first inlet port 78 of the first inlet valve chamber 76, the fluid lifting the first inlet ball 82 up and away from the first inlet port 78 as the fluid passes up through the first inlet valve chamber 76, and into the variable volume fluid compartment 48 through the fluid inlet delivery channel 74, the one-way fluid inlet valve 172, and the compartment inlet 62. This fills the variable volume fluid compartment 48 with the cleaning fluid, so that the cleaning fluid is available to be discharged from the dispenser 10 when the trigger 38 is activated again. The path that the fluid takes from the fluid reservoir 16 to the variable volume fluid compartment 48 is shown in FIG. 2 by the arrow 152.

The fluid that is drawn from the fluid reservoir 16 into the variable volume fluid compartment 48 is replaced with atmospheric air, which is drawn into the fluid reservoir 16 through the air vent channel 142. The path that the air takes through the air vent channel 142 to the fluid reservoir 16 is shown in FIG. 5 by the arrow 154. As the fluid is depleted, the atmospheric air that has been drawn into the fluid reservoir 16 gathers at the top 170 of the reservoir 16. The second inlet valve mechanism 68 prevents this air from being drawn into the variable volume fluid compartment 48 when the dispenser 10 is in the upright orientation as shown in FIG. 3B. In particular, when in the upright orientation, the weight of the second inlet ball 90 keeps it engaged with the second outlet port 88. When the piston 40 moves from the retracted position to the extended position, the negative pressure differential between the variable volume fluid compartment 48 and the fluid reservoir 16 also urges the second inlet ball 90 into engagement with the second outlet port 88. The engagement of the second inlet ball 90 with the second outlet port 88 prevents the air at the top 170 of the fluid reservoir 16 from passing through the second inlet passage 110, past the second inlet valve mechanism 68, and into the variable volume fluid compartment 48 via the fluid inlet delivery channel 74.

To dispense the fluid through the application member 18, the dispenser 10 is flipped upside down from the upright orientation shown in FIGS. 1, 2, 3A, 3B, and 3C to the inverted orientation shown in FIG. 4. With the dispenser 10 in the inverted orientation, one or more of the user's fingers are used to pull the trigger 38 axially inwardly towards the piston chamber 42. This forces the piston 40 to slide axially inwardly relative to the piston chamber 42 from the extended position to the retracted position, reducing the volume of the variable volume fluid compartment 48. As the volume of the fluid compartment 48 decreases, the fluid pressure within the variable volume fluid compartment 48 increases, causing the fluid within the variable volume fluid compartment 48 to flow outwardly through the compartment outlet 64, past the one-way fluid outlet valve 122, and through the outlet fluid receiving channel 120 to the inlet opening 130 of the outlet valve chamber 128.

If the dispenser 10 is in the inverted orientation before the trigger 38 is pulled, under gravity the outlet ball 136 engages with the first outlet opening 132, as shown in FIG. 4. The engagement of the outlet ball 136 with the first outlet opening 132 prevents the fluid received from the inlet opening 130 when the trigger 38 is pulled from passing into the first outlet opening 132 towards the first fluid outlet 116. The fluid that is received from the inlet opening 130 also increases the fluid pressure within the outlet valve chamber 128, which further urges the outlet ball 136 into engagement with the first outlet opening 132. The outlet ball 136 is spaced from the second outlet opening 134, providing a passageway for the fluid received from the inlet opening 130 to pass through the outlet valve chamber 128 into the second outlet opening 134. The fluid received by the second outlet opening 134 passes through the second outlet delivery channel 126 to the second fluid outlet 118, and is discharged from the second fluid outlet 118 into the application member 18. With the dispenser 10 in the inverted orientation and the application member 18 facing downwardly, the application member 18 can be used to apply the cleaning fluid to the surface to be cleaned, while simultaneously scrubbing the surface with the application member 18. The path that the fluid takes from the variable volume fluid compartment 48 to the second fluid outlet 118 is shown in FIG. 4 by the arrow 156.

When the trigger 38 is pulled while in the inverted orientation as shown in FIG. 4, the one-way fluid inlet valve 172 prevents the fluid from flowing from the variable volume fluid compartment 48 into the fluid inlet delivery channel 74.

When the trigger 38 is released by the user's fingers, the spring 44 pushes the piston 40 axially outwardly relative to the piston chamber 42 from the retracted position back to the extended position. This increases the volume of the variable volume fluid compartment 48, reducing the fluid pressure within the variable volume fluid compartment 48 and generating a negative pressure differential between the variable volume fluid compartment 48 and the fluid reservoir 16. The negative pressure differential causes the relatively higher pressure fluid within the fluid reservoir 16 to pass from the fluid reservoir 16 into the variable volume fluid compartment 48. When in the inverted orientation as shown in FIG. 4, the fluid within the fluid reservoir 16 pools at the top 170 of the fluid reservoir 16 under the force of gravity, and is drawn into the second passage opening 108 of the second inlet passage 110, passes through the second inlet passage 110 to the second inlet port 86 of the second inlet valve chamber 84, the fluid lifting the second inlet ball 90 up and away from the second inlet port 86 as the fluid passes up through the second inlet valve chamber 84, and into the variable volume fluid compartment 48 through the fluid inlet delivery channel 74, the one-way fluid inlet valve 172, and the compartment inlet 62. This fills the variable volume fluid compartment 48 with the cleaning fluid, so that the cleaning fluid is available to be discharged from the dispenser 10 when the trigger 38 is activated again. The path that the fluid takes from the fluid reservoir 16 to the variable volume fluid compartment 48 is shown in FIG. 4 by the arrow 158.

When in the inverted orientation as shown in FIG. 4, atmospheric air is drawn into the fluid reservoir 16 through the air vent channel 142 to replace the fluid that is dispensed from the reservoir 16. The one-way air valve 148 prevents the fluid within the reservoir 16 from leaking out through the air vent channel 142. Because the dispenser 10 is inverted, the air received from the air vent channel 142 gathers at the bottom 100 of the reservoir 16. The first inlet valve mechanism 66 prevents this air from being drawn into the variable volume fluid compartment 48. In particular, when in the inverted orientation, the weight of the first inlet ball 82 keeps it engaged with the first outlet port 80. When the piston 40 moves from the retracted position to the extended position, the negative pressure differential between the variable volume fluid compartment 48 and the fluid reservoir 16 also urges the first inlet ball 82 into engagement with the first outlet port 80. The engagement of the first inlet ball 82 with the first outlet port 80 prevents the air at the bottom 100 of the fluid reservoir 16 from passing through the dip tube 20, past the first inlet valve mechanism 66, and into the variable volume fluid compartment 48 via the fluid inlet delivery channel 74.

Figure 6:
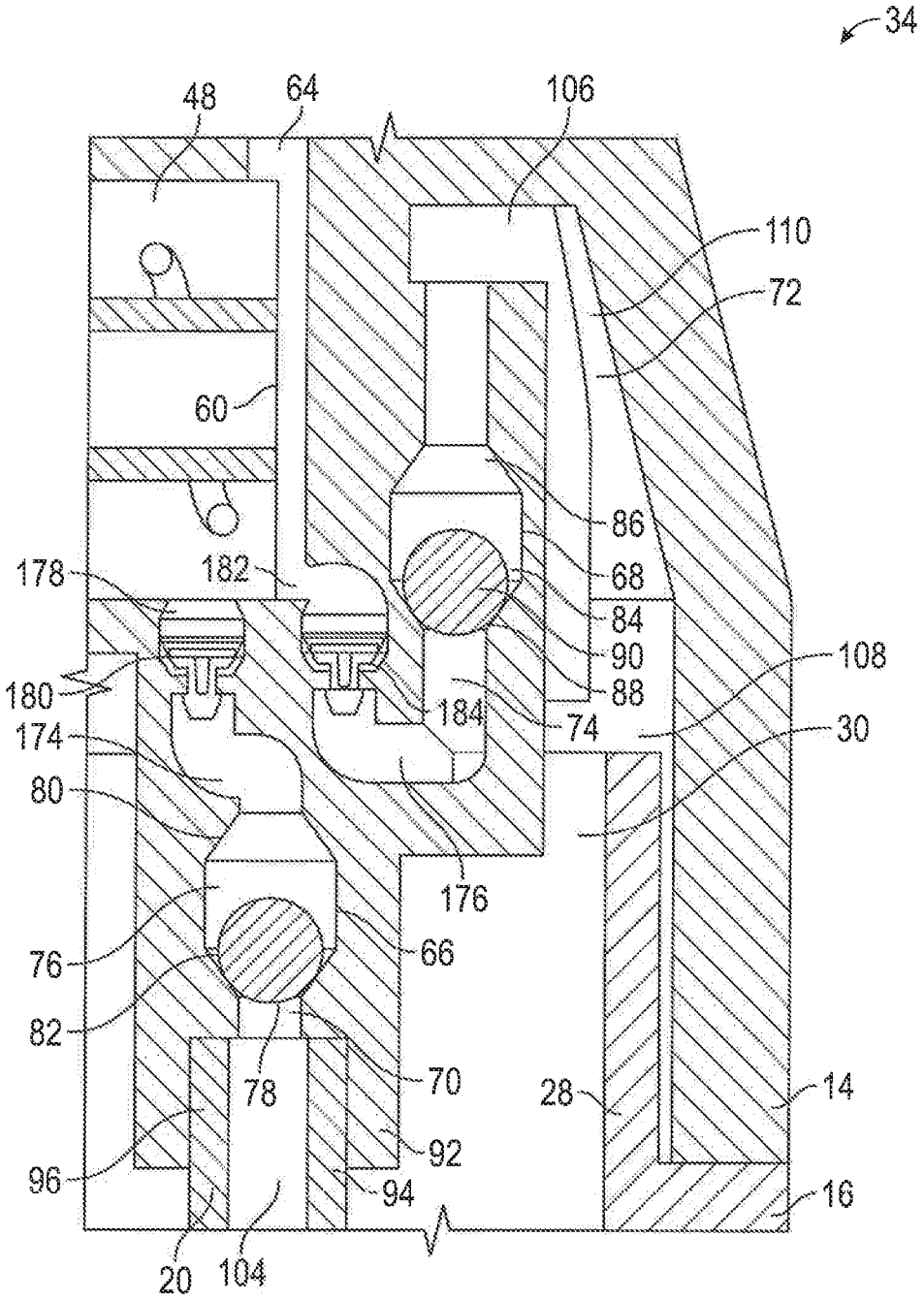
FIG. 6 is an enlarged cross-sectional view an inlet portion of a fluid dispenser in accordance with a second embodiment of the invention, with the fluid dispenser in the upright orientation.

Reference is now made to FIG. 6, which shows the inlet portion 34 of a fluid dispenser 10 in accordance with a second embodiment of the invention. The fluid dispenser 10 shown in FIG. 6 is identical to the fluid dispenser 10 shown in FIGS. 1 to 5, with the exception that the fluid inlet delivery channel 74, which receives fluid from both the first inlet valve mechanism 66 and the second inlet valve mechanism 68 in the embodiment shown in FIGS. 1 to 5, has been replaced by a first inlet delivery channel 174, which receives fluid from the first inlet valve mechanism 66, and a second inlet delivery channel 176, which receives fluid from the second inlet valve mechanism 68. Like numerals are used to denote like components.

As shown in FIG. 6, the first inlet delivery channel 174 extends from the first fluid outlet port 80 to a first compartment inlet 178 of the variable volume fluid compartment 48. A first one-way fluid inlet valve 180 is positioned within the first inlet delivery channel 174, and allows fluid to flow from the first inlet valve mechanism 66 into the first compartment inlet 178 of the variable volume fluid compartment 48, and prevents fluid from flowing from the variable volume fluid compartment 48 to the first inlet valve mechanism 66. The second inlet delivery channel 176 extends from the second fluid outlet port 88 of the second inlet valve mechanism 68 to a second compartment inlet 182 of the variable volume fluid compartment 48. A second one-way fluid inlet valve 184 is positioned within the second inlet delivery channel 176, and allows fluid to flow from the second inlet valve mechanism 68 into the second compartment inlet 182 of the variable volume fluid compartment 48, and prevents fluid from flowing from the variable volume fluid compartment 48 to the second inlet valve mechanism 68.

The fluid dispenser 10 shown in FIG. 6 functions in the same way as the dispenser 10 shown in FIGS. 1 to 5, with the only difference being that the fluid delivered to the variable volume fluid compartment 48 from the first inlet valve mechanism 66 and the second inlet valve mechanism 68 travels through separate first and second inlet delivery channels 174 and 176, respectively, rather than through a shared fluid inlet delivery channel 74.

Figure 7:
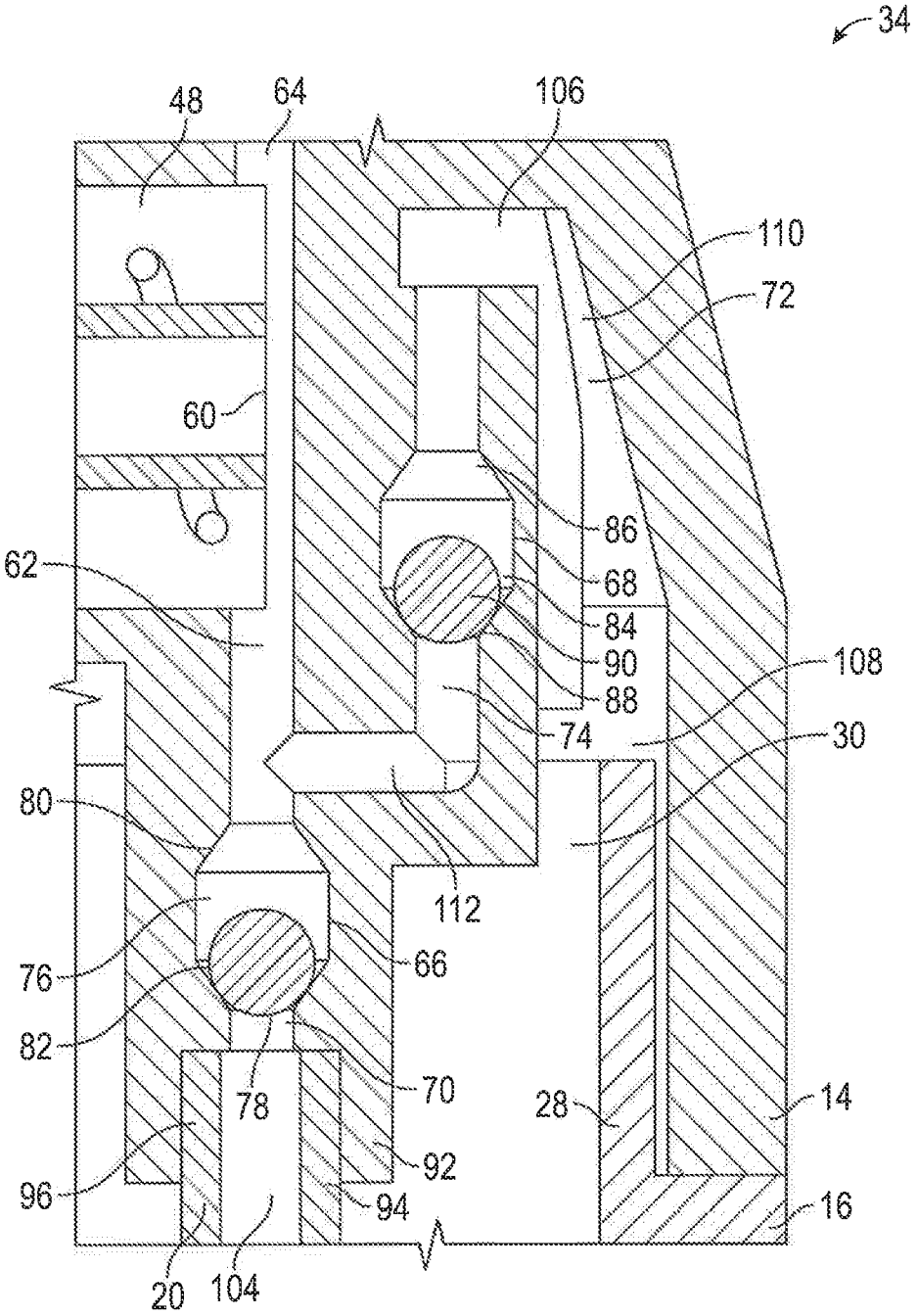
FIG. 7 is an enlarged cross-sectional view an inlet portion of a fluid dispenser in accordance with a third embodiment of the invention, with the fluid dispenser in the upright orientation.

Reference is now made to FIG. 7, which shows the inlet portion 34 of a fluid dispenser 10 in accordance with a third embodiment of the invention. The fluid dispenser 10 shown in FIG. 7 is identical to the fluid dispenser 10 shown in FIGS. 1 to 5, with the exception that there is no one-way fluid inlet valve 172 positioned within the fluid inlet delivery channel 74. Like numerals are used to denote like components.

In the embodiment shown in FIG. 7, because there is no one-way fluid inlet valve 172, the first inlet valve mechanism 66 and the second inlet valve mechanism 68 are used to prevent the fluid within the variable volume fluid compartment 48 from being expelled into the fluid reservoir 16 when the piston 40 is moved from the extended position to the retracted position. In particular, when the fluid dispenser 10 is in the upright orientation as shown in FIG. 7, the weight of the first inlet ball 82 keeps it engaged with the first inlet port 78, which prevents the fluid in the variable volume fluid compartment 48 from passing from the compartment inlet 62, through the first inlet valve mechanism 66, and into the fluid reservoir 16 via the dip tube 20. The second inlet ball 90 furthermore engages with the second outlet port 88, which prevents the fluid in the variable volume fluid compartment 48 from passing from the compartment inlet 62, through the second inlet valve mechanism 68, and into the fluid reservoir 16 via the second inlet passage 110. In the embodiment shown in FIG. 7, the weight of the second inlet ball 90, and the resistance of the one-way fluid outlet valve 122 to fluid flow therepast from the compartment outlet 64 towards the outlet valve mechanism 114, are selected so that the fluid pressure within the piston chamber 42 remains below a threshold pressure at which the second inlet ball 90 is lifted away from and out of engagement with the second outlet port 88, and the fluid in the variable volume fluid compartment 48 thus flows out through the outlet valve mechanism 114 rather than through the second inlet valve mechanism 68 towards the fluid reservoir 16.

When the fluid dispenser 10 shown in FIG. 7 is in the inverted orientation, the first inlet valve mechanism 66 and the second inlet valve mechanism 68 also prevent the fluid within the variable volume fluid compartment 48 from being expelled into the fluid reservoir 16. In particular, the weight of the second inlet ball 90 keeps it engaged with the second inlet port 86, which prevents the fluid in the variable volume fluid compartment 48 from passing from the compartment inlet 62, through the second inlet valve mechanism 68, and into the fluid reservoir 16 via the second inlet passage 110. The first inlet ball 82 furthermore engages with the first outlet port 80, which prevents the fluid in the variable volume fluid compartment 48 from passing from the compartment inlet 62, through the first inlet valve mechanism 66, and into the fluid reservoir 16 via the dip tube 20. In the embodiment shown in FIG. 7, the weight of the first inlet ball 82, and the resistance of the one-way fluid outlet valve 122 to fluid flow therepast from the compartment outlet 64 towards the outlet valve mechanism 114, are selected so that the fluid pressure within the piston chamber 42 remains below a threshold pressure at which the first inlet ball 82 is lifted away from and out of engagement with the first outlet port 80, and the fluid in the variable volume fluid compartment 48 thus flows out through the outlet valve mechanism 114 rather than through the first inlet valve mechanism 66 towards the fluid reservoir 16. The fluid dispenser 10 shown in FIG. 7 otherwise operates in an identical manner to the dispenser 10 shown in FIGS. 1 to 5. The fluid dispenser 10 shown in FIG. 6 could also be modified to eliminate the first one-way fluid inlet valve 180 and the second one-way fluid inlet valve 184, and function like the fluid dispenser 10 shown in FIG. 7, with the first inlet ball 82 and the second inlet ball 90 preventing the fluid within the variable volume fluid compartment 48 from being expelled into the fluid reservoir 16.

It will be understood that, although various features of the invention have been described with respect to one or another of the embodiments of the invention, the various features and embodiments of the invention may be combined or used in conjunction with other features and embodiments of the invention as described and illustrated herein.

The fluid dispenser 10 is not limited to the particular construction shown and described herein. Nor are the valve mechanisms 66, 68, 114 limited to the particular constructions that have been shown. For example, in alternative embodiments the first inlet ball 82, the second inlet ball 90, and the outlet ball 136 could be replaced with moveable valve members having a non-spherical shape, such as a cylindrical shape with rounded or cone-shaped ends, that likewise move under the force of gravity to direct the flow of fluid through the valve mechanisms 66, 68, 114 in dependence on the orientation of the dispenser 10 relative to the gravitational pull of the Earth.

The upright orientation and the inverted orientation as described herein are not limited to the precise orientations shown in the drawings. For example, the upright orientation includes any orientation in which the outlet ball 136 engages with the second outlet opening 134 under the force of gravity, and includes orientations in which the dispenser 10 is generally upright but is angled upwardly or downwardly from the orientation shown in FIG. 3. The inverted orientation likewise includes any orientation in which the outlet ball 136 engages with the first outlet opening 132 under the force of gravity, and includes orientations in which the dispenser 10 is generally inverted but is angled upwardly or downwardly from the orientation shown in FIG. 4.

Although the fluid is preferably a surface cleaning fluid, such as a liquid detergent or disinfectant, the dispenser 10 could be used to dispense other fluids as well. For example, the dispenser 10 could be used to dispense fluids for personal hygiene, such as hand cleaning fluid, body wash, shampoo, or conditioner. The term "fluid" as used herein includes any flowable substance, including liquids, foams, emulsions, and dispersions.

Although the application member 18 has been described as a synthetic sponge, other types of application members 18 could also be used. For example, the application member 18 could include a scrubbing tool, a wiping tool, a scraping tool, a polishing tool, a cleaning tool, a natural sponge, a cloth, a brush, a roller applicator, or a wipe pad. The application member 18 could also be permanently attached to the spray handle 14, or could be removable and replaceable. In some embodiments of the invention, the second fluid outlet 118 may discharge fluid adjacent to, rather than directly into, the application member 18. In some embodiments, the dispenser 10 could optionally store and dispense a supply of application members 18, such as a roll of wipes or the like.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A fluid dispenser comprising:

a fluid reservoir containing a fluid to be dispensed;

a first fluid outlet for dispensing the fluid when the fluid dispenser is in a first orientation;

a second fluid outlet for dispensing the fluid when the fluid dispenser is in a second orientation;

an outlet valve mechanism for directing the fluid towards the first fluid outlet when the fluid dispenser is in the first orientation, and towards the second fluid outlet when the fluid dispenser is in the second orientation; and a pump mechanism that, when activated, forces an allotment of the fluid through the outlet valve mechanism to be discharged from either the first fluid outlet or the second fluid outlet;

wherein the outlet valve mechanism comprises a movable outlet member that is located at a first position when the fluid dispenser is in the first orientation, and is located at a second position when the fluid dispenser is in the second orientation;

wherein the movable outlet member moves from the first position to the second position under the force of gravity when the fluid dispenser moves from the first orientation to the second orientation;

wherein the movable outlet member moves from the second position to the first position under the force of gravity when the fluid dispenser moves from the second orientation to the first orientation;

wherein, when the movable outlet member is at the first position, the outlet valve mechanism allows the fluid to pass through the outlet valve mechanism towards the first fluid outlet, and prevents the fluid from passing through the outlet valve mechanism towards the second fluid outlet; and wherein, when the movable outlet member is at the second position, the outlet valve mechanism allows the fluid to pass through the outlet valve mechanism towards the second fluid outlet, and prevents the fluid from passing through the outlet valve mechanism towards the first fluid outlet.

2. The fluid dispenser according to claim 1, wherein the movable outlet member is movably disposed within an outlet valve chamber, the outlet valve chamber having an inlet opening, a first outlet opening, and a second outlet opening;

wherein the inlet opening is in fluid communication with the pump mechanism for receiving the fluid upon activation of the pump mechanism;

wherein the first outlet opening is in fluid communication with the first fluid outlet;

wherein the second outlet opening is in fluid communication with the second fluid outlet;

wherein, when the movable outlet member is at the first position:

(i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; and wherein, when the movable outlet member is at the second position:

(i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening.

3. The fluid dispenser according to claim 2, wherein the movable outlet member comprises an outlet ball;

wherein, when the fluid dispenser is in the first orientation and the outlet ball is at the first position:

(i) the outlet ball is located downwardly from the first outlet opening, and (ii) the outlet ball is located upwardly from the second outlet opening; and wherein, when the fluid dispenser is in the second orientation and the outlet ball is at the second position:

(i) the outlet ball is located upwardly from the first outlet opening, and (ii) the outlet ball is located downwardly from the second outlet opening.

4. The fluid dispenser according to claim 1, further comprising:

a first inlet valve mechanism for delivering the fluid from the fluid reservoir to the pump mechanism when the fluid dispenser is in the first orientation; and a second inlet valve mechanism for delivering the fluid from the fluid reservoir to the pump mechanism when the fluid dispenser is in the second orientation;

wherein the first inlet valve mechanism comprises a first movable inlet member that is located at a first position when the fluid dispenser is in the first orientation, and is located at a second position when the fluid dispenser is in the second orientation;

wherein the first movable inlet member moves from the first position to the second position under the force of gravity when the fluid dispenser moves from the first orientation to the second orientation;

wherein the first movable inlet member moves from the second position to the first position under the force of gravity when the fluid dispenser moves from the second orientation to the first orientation;

wherein, when the first movable inlet member is at the first position, the first inlet valve mechanism allows fluid to pass from the fluid reservoir, through the first inlet valve mechanism, to the pump mechanism;

wherein, when the first movable inlet member is at the second position, the first inlet valve mechanism prevents fluid from passing from the fluid reservoir, through the first inlet valve mechanism, to the pump mechanism;

wherein the second inlet valve mechanism comprises a second movable inlet member that is located at a first position when the fluid dispenser is in the first orientation, and is located at a second position when the fluid dispenser is in the second orientation;

wherein the second movable inlet member moves from the first position to the second position under the force of gravity when the fluid dispenser moves from the first orientation to the second orientation;

wherein the second movable inlet member moves from the second position to the first position under the force of gravity when the fluid dispenser moves from the second orientation to the first orientation;

wherein, when the second movable inlet member is at the first position, the second inlet valve mechanism prevents fluid from passing from the fluid reservoir, through the second inlet valve mechanism, to the pump mechanism; and wherein, when the second movable inlet member is at the second position, the second inlet valve mechanism allows fluid to pass from the fluid reservoir, through the second inlet valve mechanism, to the pump mechanism.

5. The fluid dispenser according to claim 4, wherein the first movable inlet member is movably disposed within a first inlet valve chamber, the first inlet valve chamber having a first inlet port and a first outlet port;

wherein the first inlet port is in fluid communication with the fluid reservoir;

wherein the first outlet port is in fluid communication with the pump mechanism;

wherein, when the first movable inlet member is at the first position, the first movable inlet member is spaced from the first outlet port and engages with the first inlet port, and allows fluid to pass from the fluid reservoir, through the first inlet valve chamber, to the pump mechanism;

wherein, when the first movable inlet member is at the second position, the first movable inlet member is spaced from the first inlet port and engages with the first outlet port to prevent fluid from passing from the fluid reservoir, through the first inlet valve chamber, to the pump mechanism;

wherein the second movable inlet member is movably disposed within a second inlet valve chamber, the second inlet valve chamber having a second inlet port and a second outlet port;

wherein the second inlet port is in fluid communication with the fluid reservoir;

wherein the second outlet port is in fluid communication with the pump mechanism;

wherein, when the second movable inlet member is at the first position, the second movable inlet member is spaced from the second inlet port and engages with the second outlet port to prevent fluid from passing from the fluid reservoir, through the second inlet valve chamber, to the pump mechanism; and wherein, when the second movable inlet member is at the second position, the second movable inlet member is spaced from the second outlet port and engages with the second inlet port, and allows fluid to pass from the fluid reservoir, through the second inlet valve chamber, to the pump mechanism.

6. The fluid dispenser according to claim 5, wherein the first movable inlet member comprises a first inlet ball;

wherein, when the fluid dispenser is in the first orientation and the first inlet ball is at the first position:

(i) the first inlet ball is located downwardly from the first outlet port, and (ii) the first inlet ball is located upwardly from the first inlet port;

wherein, when the fluid dispenser is in the second orientation and the first inlet ball is at the second position:

(i) the first inlet ball is located upwardly from the first outlet port, and (ii) the first inlet ball is located downwardly from the first inlet port;

wherein the second movable inlet member comprises a second inlet ball;

wherein, when the fluid dispenser is in the first orientation and the second inlet ball is at the first position:

(i) the second inlet ball is located upwardly from the second outlet port, and (ii) the second inlet ball is located downwardly from the second inlet port; and wherein, when the fluid dispenser is in the second orientation and the second inlet ball is at the second position:

(i) the second inlet ball is located downwardly from the second outlet port, and (ii) the second inlet ball is located upwardly from the second inlet port.

7. The fluid dispenser according to claim 6, wherein the pump mechanism comprises a variable volume fluid compartment that is in fluid communication with the outlet valve mechanism, the first inlet valve mechanism, and the second inlet valve mechanism;

wherein the variable volume fluid compartment has an internal volume that, upon activation of the pump mechanism, cycles between an expanded volume and a reduced volume;

wherein the fluid dispenser further comprises a one-way fluid outlet valve that allows fluid to pass from the variable volume fluid compartment, past the one-way fluid outlet valve, to the outlet valve mechanism, and prevents fluid from passing from the outlet valve mechanism, past the one-way fluid outlet valve, to the variable volume fluid compartment;

wherein the fluid dispenser further comprises at least one one-way fluid inlet valve that allows fluid to pass from the first inlet valve mechanism and the second inlet valve mechanism to the variable volume fluid compartment, and prevents fluid from passing from the variable volume fluid compartment to the first inlet valve mechanism and the second inlet valve mechanism;

wherein, when the fluid dispenser is in the first orientation and the internal volume of the variable volume fluid compartment is increased from the reduced volume to the expanded volume:

(i) a fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the first inlet valve chamber, to the variable volume fluid compartment, (iii) the engagement of the second inlet ball with the second outlet port prevents fluid from passing from the fluid reservoir, through the second inlet valve chamber, to the variable volume fluid compartment, and (iv) the one-way fluid outlet valve prevents fluid from passing from the outlet valve mechanism, past the one-way fluid outlet valve, to the variable volume fluid compartment;

wherein, when the fluid dispenser is in the first orientation and the internal volume of the variable volume fluid compartment is decreased from the expanded volume to the reduced volume:

(i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the at least one one-way fluid inlet valve, and through the outlet valve mechanism, to be dispensed from the first fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir;

wherein, when the fluid dispenser is in the second orientation and the internal volume of the variable volume fluid compartment is increased from the reduced volume to the expanded volume:

(i) the fluid pressure within the variable volume fluid compartment decreases, generating a negative pressure differential between the variable volume fluid compartment and the fluid reservoir, (ii) the negative pressure differential between the variable volume fluid compartment and the fluid reservoir causes the fluid within the fluid reservoir to pass from the fluid reservoir, through the second inlet valve chamber, to the variable volume fluid compartment, (iii) the engagement of the first inlet ball with the first outlet port prevents fluid from passing from the fluid reservoir, through the first inlet valve chamber, to the variable volume fluid compartment, and (iv) the one-way fluid outlet valve prevents fluid from passing from the outlet valve mechanism, past the one-way fluid outlet valve, to the variable volume fluid compartment; and wherein, when the fluid dispenser is in the second orientation and the internal volume of the variable volume fluid compartment is decreased from the expanded volume to the reduced volume:

(i) the fluid pressure within the variable volume fluid compartment increases, generating a positive pressure differential between the variable volume fluid compartment and the atmospheric air surrounding the fluid dispenser, (ii) the positive pressure differential between the variable volume fluid compartment and the atmospheric air causes the fluid within the variable volume fluid compartment to pass from the variable volume fluid compartment, past the at least one one-way fluid inlet valve, and through the outlet valve mechanism, to be dispensed from the second fluid outlet, (iii) the at least one one-way fluid inlet valve prevents fluid from passing from the variable volume fluid compartment, through the first inlet valve chamber, to the fluid reservoir, and (iv) the at least one one-way fluid inlet valve prevents fluid from passing from the variable volume fluid compartment, through the second inlet valve chamber, to the fluid reservoir.

8. The fluid dispenser according to claim 7, wherein a weight of the first inlet ball is selected so that, when the fluid dispenser is in the first orientation and the internal volume of the variable volume fluid compartment is increased from the reduced volume to the expanded volume, the negative pressure differential between the variable volume fluid compartment and the fluid reservoir is sufficient to lift the first inlet ball away from the first inlet port to allow the fluid to pass from the fluid reservoir, through the first inlet valve chamber, to the variable volume fluid compartment;

wherein a weight of the second inlet ball is selected so that, when the fluid dispenser is in the second orientation and the internal volume of the variable volume fluid compartment is increased from the reduced volume to the expanded volume, the negative pressure differential between the variable volume fluid compartment and the fluid reservoir is sufficient to lift the second inlet ball away from the second inlet port to allow the fluid to pass from the fluid reservoir, through the second inlet valve chamber, to the variable volume fluid compartment.

9. The fluid dispenser according to claim 4, further comprising:

a first inlet passage in fluid communication with the first inlet valve mechanism and the fluid reservoir; and a second inlet passage in fluid communication with the second inlet valve mechanism and the fluid reservoir;

wherein the first inlet passage has a first passage opening for receiving the fluid from the fluid reservoir;

wherein the second inlet passage has a second passage opening for receiving the fluid from the fluid reservoir;

wherein, when the fluid dispenser is in the first orientation, the first passage opening is located below the second passage opening; and wherein, when the fluid dispenser is in the second orientation, the first passage opening is located above the second passage opening.

10. The fluid dispenser according to claim 9, wherein the first orientation is an upright orientation and the second orientation is an inverted orientation;

wherein the first passage opening is positioned to receive the fluid from a bottom portion of the fluid reservoir; and wherein the second passage opening is positioned to receive the fluid from a top portion of the fluid reservoir.

11. The fluid dispenser according to claim 1, wherein the first fluid outlet comprises a nozzle that, upon activation of the pump mechanism while the fluid dispenser is in the first orientation, discharges the fluid as a stream or a spray that is directed away from the fluid dispenser.

12. The fluid dispenser according to claim 1, further comprising an application member for applying the fluid to a surface;

wherein the application member is located proximate to the second fluid outlet so that, upon activation of the pump mechanism while the fluid dispenser is in the second orientation, the second fluid outlet discharges the fluid into or adjacent to the application member.

13. The fluid dispenser according to claim 12, wherein the application member comprises at least one of: a scrubbing tool, a wiping tool, a scraping tool, a polishing tool, a cleaning tool, a natural sponge, a synthetic sponge, a cloth, a brush, a roller applicator, and a wipe pad.

14. The fluid dispenser according to claim 1, further comprising:

a handle portion for manually carrying the fluid dispenser with a user's hand; and an actuator that is manually operable to activate the pump mechanism;

wherein the actuator is located on or proximate to the handle portion so as to be accessible for manual operation by a user's finger or fingers while gripping the handle portion with the user's hand in both the first orientation and the second orientation.

15. The fluid dispenser according to claim 1, further comprising a one-way air valve that allows atmospheric air to enter the fluid reservoir through the one-way air valve, and prevents fluid from exiting the fluid reservoir through the one-way air valve, when the fluid dispenser is in the first orientation and the second orientation.

16. The fluid dispenser according to claim 1, wherein the fluid comprises a surface cleaning fluid.

17. The fluid dispenser according to claim 5, wherein the movable outlet member is movably disposed within an outlet valve chamber, the outlet valve chamber having an inlet opening, a first outlet opening, and a second outlet opening;

wherein the inlet opening is in fluid communication with the pump mechanism for receiving the fluid upon activation of the pump mechanism;

wherein the first outlet opening is in fluid communication with the first fluid outlet;

wherein the second outlet opening is in fluid communication with the second fluid outlet;

wherein, when the movable outlet member is at the first position:

(i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening; and wherein, when the movable outlet member is at the second position:

(i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening.

18. The fluid dispenser according to claim 17, further comprising an application member for applying the fluid to a surface;

wherein the first fluid outlet comprises a nozzle that, upon activation of the pump mechanism while the fluid dispenser is in the first orientation, discharges the fluid as a stream or a spray that is directed away from the fluid dispenser; and wherein the application member is located proximate to the second fluid outlet so that, upon activation of the pump mechanism while the fluid dispenser is in the second orientation, the second fluid outlet discharges the fluid into or adjacent to the application member.

19. The fluid dispenser according to claim 18, further comprising:

a handle portion for manually carrying the fluid dispenser with a user's hand; and an actuator that is manually operable to activate the pump mechanism;

wherein the actuator is located on or proximate to the handle portion so as to be accessible for manual operation by a user's finger or fingers while gripping the handle portion with the user's hand in both the first orientation and the second orientation; and wherein the fluid comprises a surface cleaning fluid.

20. The fluid dispenser according to claim 7, wherein the movable outlet member is movably disposed within an outlet valve chamber, the outlet valve chamber having an inlet opening, a first outlet opening, and a second outlet opening;

wherein the inlet opening is in fluid communication with the pump mechanism for receiving the fluid upon activation of the pump mechanism;

wherein the first outlet opening is in fluid communication with the first fluid outlet;

wherein the second outlet opening is in fluid communication with the second fluid outlet;

wherein, when the movable outlet member is at the first position:

(i) the movable outlet member engages with the second outlet opening to prevent the fluid from passing through the outlet valve chamber towards the second fluid outlet, and (ii) the movable outlet member is spaced from the inlet opening and the first outlet opening to provide a passageway for the fluid to pass from the inlet opening, through the outlet valve chamber, and into the first outlet opening;

wherein, when the movable outlet member is at the second position:

(i) the movable outlet member engages with the first outlet opening to prevent the fluid from passing through the outlet valve chamber towards the first fluid outlet, and (ii) the movable outlet member is spaced from the inlet opening and the second outlet opening to provide a passageway for the fluid to pass from the inlet opening, through the outlet valve chamber, and into the second outlet opening;

wherein the movable outlet member comprises an outlet ball;

wherein, when the fluid dispenser is in the first orientation and the outlet ball is at the first position:

(i) the outlet ball is located downwardly from the first outlet opening, and (ii) the outlet ball is located upwardly from the second outlet opening;

wherein, when the fluid dispenser is in the second orientation and the outlet ball is at the second position:

(i) the outlet ball is located upwardly from the first outlet opening, and (ii) the outlet ball is located downwardly from the second outlet opening;

the fluid dispenser further comprising:

a first inlet passage in fluid communication with the first inlet valve mechanism and the fluid reservoir; and a second inlet passage in fluid communication with the second inlet valve mechanism and the fluid reservoir;

wherein the first inlet passage has a first passage opening for receiving the fluid from the fluid reservoir;

wherein the second inlet passage has a second passage opening for receiving the fluid from the fluid reservoir;

wherein, when the fluid dispenser is in the first orientation, the first passage opening is located below the second passage opening;

wherein, when the fluid dispenser is in the second orientation, the first passage opening is located above the second passage opening;

wherein the first orientation is an upright orientation and the second orientation is an inverted orientation;

wherein the first passage opening is positioned to receive the fluid from a bottom portion of the fluid reservoir;

wherein the second passage opening is positioned to receive the fluid from a top portion of the fluid reservoir;

the fluid dispenser further comprising an application member for applying the fluid to a surface;

wherein the first fluid outlet comprises a nozzle that, upon activation of the pump mechanism while the fluid dispenser is in the first orientation, discharges the fluid as a stream or a spray that is directed away from the fluid dispenser;

wherein the application member is located proximate to the second fluid outlet so that, upon activation of the pump mechanism while the fluid dispenser is in the second orientation, the second fluid outlet discharges the fluid into or adjacent to the application member;

the fluid dispenser further comprising:

a handle portion for manually carrying the fluid dispenser with a user's hand; and an actuator that is manually operable to activate the pump mechanism;

wherein the actuator is located on or proximate to the handle portion so as to be accessible for manual operation by a user's finger or fingers while gripping the handle portion with the user's hand in both the first orientation and the second orientation; and wherein the fluid comprises a surface cleaning fluid.

* * * * *